US010818167B2

(12) United States Patent
Lu et al.

(10) Patent No.: US 10,818,167 B2
(45) **Date of Patent: *Oct. 27, 2020**

(54) TRAFFIC OBSTRUCTION NOTIFICATION SYSTEM BASED ON WIRELESS VEHICLE DATA

(71) Applicant: TOYOTA JIDOSHA KABUSHIKI KAISHA, Toyota-shi, Aichi-ken (JP)

(72) Inventors: Hongsheng Lu, Mountain View, CA (US); Gaurav Bansal, Mountain View, CA (US); John Kenney, Mountain View, CA (US); Toru Nakanishi, Toyota (JP)

( * ) Notice: Subject to any disclaimer, the term of this patent is extended or adjusted under 35 U.S.C. 154(b) by 190 days.

This patent is subject to a terminal disclaimer.

(21) Appl. No.: 15/994,212

(22) Filed: May 31, 2018

(65) Prior Publication Data

US 2018/0286225 A1 Oct. 4, 2018

Related U.S. Application Data

(63) Continuation of application No. 15/187,504, filed on Jun. 20, 2016, now Pat. No. 10,013,877.

(51) Int. Cl.
*G08G 1/01* (2006.01)
*G08G 1/0967* (2006.01)

(52) U.S. Cl.
CPC ..... *G08G 1/0141* (2013.01); *G08G 1/0112* (2013.01); *G08G 1/0129* (2013.01); (Continued)

(58) Field of Classification Search
CPC .. G08G 1/0141; G08G 1/0112; G08G 1/0129; G08G 1/0133; G08G 1/0967; G08G 1/096783
See application file for complete search history.

(56) References Cited

U.S. PATENT DOCUMENTS 5,294,210 A 3/1994 Lemelson
6,380,849 B1 4/2002 Eckstine et al.
(Continued)

FOREIGN PATENT DOCUMENTS

JP 2004-078333 3/2004
JP 2005-242552 9/2005
(Continued)

*Primary Examiner* — Calvin Cheung
(74) *Attorney, Agent, or Firm* — Burbage Law, P.C.; Jon-Michael Burbage; Elizabeth Ruzich

(57) ABSTRACT

The disclosure includes implementations for estimating a presence of an obstruction in a roadway using wireless vehicle data. A method may include receiving a Dedicated Short Range Communication ("DSRC") message that includes path history data describing a path of a first DSRC-equipped vehicle with lane-level accuracy over a plurality of different times while the first DSRC-equipped vehicle is traveling on a roadway. The method may include determining a presence of an obstruction in a specific lane of the roadway based on the path history data. The obstruction may be indicated by the path history data because the path history data indicates that the obstruction affected the path of the first DSRC-equipped vehicle while traveling in the specific lane of the roadway. The method may include providing a recommendation to a driver of a second DSRC-equipped vehicle. The recommendation may describe the presence of the obstruction in the specific lane.

20 Claims, 8 Drawing Sheets

(52) U.S. Cl.
CPC ..... *G08G 1/0133* (2013.01); *G08G 1/0967* (2013.01); *G08G 1/096783* (2013.01)

(56) References Cited

U.S. PATENT DOCUMENTS

| | | | | |
|---|---|---|---|---|
| 9,667,405 | B2 | 5/2017 | Kenney et al. | |
| 2010/0036859 | A1 | 2/2010 | Pinto et al. | |
| 2010/0256852 | A1 | 10/2010 | Mudalige | |
| 2011/0009151 | A1 | 1/2011 | Miucic | |
| 2011/0196592 | A1 | 8/2011 | Kashi et al. | |
| 2011/0238259 | A1* | 9/2011 | Bai | H04L 67/125 701/31.4 |
| 2012/0053805 | A1 | 3/2012 | Dantu | |
| 2012/0327840 | A1 | 12/2012 | Chen et al. | |
| 2013/0279393 | A1 | 10/2013 | Rubin et al. | |
| 2013/0325306 | A1 | 12/2013 | Caveney et al. | |
| 2014/0067220 | A1 | 3/2014 | Seiler | |
| 2016/0071418 | A1 | 3/2016 | Oshida et al. | |
| 2016/0231746 | A1 | 8/2016 | Hazelton et al. | |
| 2017/0019887 | A1 | 1/2017 | Jiang et al. | |
| 2017/0261990 | A1* | 9/2017 | Lei | B60W 30/08 |
| 2017/0268896 | A1* | 9/2017 | Bai | G01C 21/3697 |

FOREIGN PATENT DOCUMENTS

| | | |
|---|---|---|
| JP | 2006-229692 | 8/2006 |
| JP | 2010-044529 | 2/2010 |
| JP | 2012-533219 | 12/2012 |

* cited by examiner

BSM DATA 195

- Vehicles and other client devices equipped with Dedicated Short Range Communication ("DSRC") transmit a Basic Safety Message ("BSM") at a regular interval.

- Each BSM includes the following BSM data describing one or more of the following for the vehicle that originally sent the BSM:
  (1) Location Data Describing the Location of the Vehicle, where the Location Data may be so accurate that it describes the specific lane the Vehicle is traveling in;
  (2) Heading Data Describing the Direction of travel for the Vehicle;
  (3) Velocity Data Describing the Velocity of the Vehicle; and
  (4) Path History of Vehicle (e.g., path history data).

Figure 4A

BSM DATA 195

Part 1

Vehicle Position Data (local 3D)

- Latitude
- Longitude
- Elevation
- Positional accuracy
- Time

Vehicle Motion Data

- Transmission state
- Speed
- Heading
- Steering wheel angle
- Acceleration set (4-way, i.e., 3 axes of acceleration plus yaw rate
- Brake system status Vehicle Size Data

Part 2

Vehicle Path History
Future Vehicle Path Estimation
Hard Active Braking
Traction Control System active over 100 milliseconds?
Antilock Brake System active over 100 milliseconds?
Light Status
Wiper Status
Vehicle type

Figure 4B

TRAFFIC OBSTRUCTION NOTIFICATION SYSTEM BASED ON WIRELESS VEHICLE DATA

CROSS-REFERENCE TO RELATED APPLICATIONS

This patent application is a continuation of U.S. patent application Ser. No. 15/187,504, entitled "Traffic Obstruction Notification System Based on Wireless Vehicle Data" and filed on Mar. 20, 2016, the entirety of which is hereby incorporated by reference.

BACKGROUND

The specification relates to traffic obstruction notifications based on wireless vehicle data. The traffic obstruction notifications may be provided to a connected vehicle that is equipped with Dedicated Short Range Communication.

Drivers of vehicles do not want to be at risk from traffic obstructions. Such obstructions include, for example: potholes; wrecks; animals; people; roadway debris; ice patches; puddles; or any other roadway condition that may cause a driver to modify the operation of the vehicle to avoid the obstruction. Interacting with such obstructions may be a safety risk for the driver or may damage the driver's vehicle.

SUMMARY

Described are implementations that include a system, method and a computer program product for providing a notification of a traffic obstruction based on wireless vehicle data included in a wireless message. The wireless message may include a Dedicated Short Range Communication ("DSRC") message or some other type of wireless message.

In some implementations, the DSRC message may be a Basic Safety Message ("BSM") that is transmitted via DSRC.

In some implementations, a DSRC-equipped vehicle may include a vehicle that includes one or more of the following elements: a DSRC transceiver and any software or hardware necessary to encode and transmit a DSRC message; a DSRC receiver and any software or hardware necessary to receive and decode a DSRC message; and a DSRC-compliant Global Positioning System (a "DSRC-compliant GPS system").

A DSRC-compliant GPS unit can provide location data describing the location of a vehicle with lane-level accuracy. Lane level accuracy may mean that the location of a vehicle is described so accurately that the vehicle's lane of travel may be accurately determined. A conventional GPS system is unable to determine the location of a vehicle with lane-level accuracy. For example, a typical lane of a roadway is approximately 3 meters wide. However, a conventional GPS system may only have an accuracy of plus or minus 10 meters relative to the actual location of the vehicle.

A DSRC-compliant GPS unit may include hardware that wirelessly communicates with a GPS satellite to retrieve location data that describes a location of a vehicle with a precision that is compliant with the DSRC standard. The DSRC standard requires that location data be precise enough to infer if two vehicles are in the same lane. A DSRC-compliant GPS unit may be operable to identify, monitor and track its two-dimensional position within 1.5 meters of its actual position 68% of the time under an open sky. Since lanes of a roadway are typically no less than 3 meters wide, whenever the two dimensional error of the location data is less than 1.5 meters the estimation system described herein may analyze the location data provided by the DSRC-compliant GPS unit and determine what lane of the roadway the vehicle is traveling in based on the relative positions of vehicles on the roadway. In this way, the DSRC-compliant GPS unit may beneficially provide location data with lane-level accuracy.

In some implementations, devices other than vehicles may be DSRC-equipped. For example, a roadside unit ("RSU") or any other communication device may be DSRC-equipped if it includes one or more of the following elements: a DSRC transceiver and any software or hardware necessary to encode and transmit a DSRC message; and a DSRC receiver and any software or hardware necessary to receive and decode a DSRC message.

The implementations described herein may use wireless vehicle data included in a wireless message such as a DSRC message or a BSM to provide an estimate of whether one or more traffic obstructions are present on the roadway. Implementations may provide a notification to drivers about the presence of the obstruction. The notification may be configured to occurs in sufficient time for the driver to safely respond to the obstruction.

No other technologies utilize wireless vehicle data included in a DSRC message or a BSM to: (1) estimate the presence of an obstruction based on wireless vehicle data or (2) provide a notification to a driver describing the presence of the obstruction in sufficient time for the driver to safely respond to the obstruction.

A system of one or more computers can be configured to perform particular operations or actions by virtue of having software, firmware, hardware, or a combination of them installed on the system that in operation causes or cause the system to perform the actions. One or more computer programs can be configured to perform particular operations or actions by virtue of including instructions that, when executed by data processing apparatus, cause the apparatus to perform the actions.

One general aspect includes a method including: collecting, by a sensor set included in a first DSRC-equipped vehicle, sensor data that describes a plurality of locations of the first DSRC-equipped vehicle with lane-level accuracy at a plurality of different times while the first DSRC-equipped vehicle is traveling on a roadway, where the sensor set includes a DSRC-compliant GPS unit that generates the sensor data describing the plurality of locations with lane-level accuracy; building, by the first DSRC-equipped vehicle, first path history data based on the sensor data, where the first path history data describes a path of the first DSRC-equipped vehicle with lane-level accuracy over the plurality of different times while the first DSRC-equipped vehicle is traveling the roadway; wirelessly transmitting, by the first DSRC-equipped vehicle, a DSRC message that includes the first path history data to a second DSRC-equipped vehicle; receiving the DSRC message by the second DSRC-equipped vehicle; receiving a wireless message by the second DSRC-equipped vehicle, where the wireless message is transmitted by a computing device and includes second path history data for one or more other vehicles that describes one or more paths of the one or more other vehicles while traveling on the roadway; determining, by the second DSRC-equipped vehicle, a presence of an obstruction in a specific lane of a roadway based on the first path history data and the second path history, where the obstruction is indicated by the first path history data and the second path history data because the first path history data and at least a portion of the second path history data indicates that the obstruction modified the path of the first DSRC-equipped vehicle and at least one of the one or more other vehicles while traveling in the specific lane of the roadway; and providing, by the second DSRC-equipped vehicle, a recommendation to a driver of the second DSRC-equipped vehicle, where the recommendation describes the presence of the obstruction in the specific lane of the roadway. Other embodiments of this aspect include corresponding computer systems, apparatus, and computer programs recorded on one or more computer storage devices, each configured to perform the actions of the methods.

Implementations may include one or more of the following features. The method where one or more of the DSRC message and the wireless message is a basic safety message. The method where lane-level accuracy includes the location of the first DSRC-equipped vehicle being described by the sensor data with an accuracy of substantially plus or minus 1.5 meters where the specific lane of the roadway is substantially 3 meters wide. The method where at least one of the one or more other vehicles is not equipped to transmit DSRC messages or receive DSRC messages. The method where the computing device is a Roadside Unit that aggregates the second path history data from the one or more other vehicles. The method where the computing device is a server that receives the second path history data from one or more Roadside Units that aggregate the second path history data from the one or more other vehicles. The method where the wireless message is a full-duplex wireless message. The method where the presence of the obstruction is only determined if the first path history data and the second path history data indicate that a number of vehicles experienced the obstruction and the number exceeds a predetermined threshold of vehicles. The method further including an Advanced Driver Assistance System of the vehicle operating the second DSRC-equipped vehicle to respond to the determination of the presence of the obstruction. Implementations of the described techniques may include hardware, a method or process, or computer software on a computer-accessible medium.

One general aspect includes a system including: a DSRC receiver of a second DSRC-equipped vehicle that is operable to receive a DSRC message that includes path history data describing a path of a first DSRC-equipped vehicle with lane-level accuracy over a plurality of different times while the first DSRC-equipped vehicle is traveling on a roadway; an onboard vehicle computer system of the second DSRC-equipped vehicle that is communicatively coupled to the DSRC receiver to receive the path history data from the DSRC receiver, the onboard vehicle computer system including a non-transitory memory storing computer code which, when executed by the onboard vehicle computer system causes the onboard vehicle computer system to: determine a presence of an obstruction in a specific lane of the roadway based on the path history data, where the obstruction is indicated by the path history data because the path history data indicates that the obstruction affected the path of the first DSRC-equipped vehicle while traveling in the specific lane of the roadway; and provide a recommendation to a driver of the second DSRC-equipped vehicle, where the recommendation describes the presence of the obstruction in the specific lane of the roadway. Other embodiments of this aspect include corresponding computer systems, apparatus, and computer programs recorded on one or more computer storage devices, each configured to perform the actions of the methods.

Implementations may include one or more of the following features. The system where the DSRC message is a basic safety message. The system where lane-level accuracy includes one or more locations of the second DSRC-equipped vehicle being described by the path history data with an accuracy of substantially plus or minus 1.5 meters where the specific lane of the roadway is substantially 3 meters wide. The system where the system further includes an Advanced Driver Assistance System communicatively coupled to the onboard vehicle computer system and where the non-transitory memory further stores computer code which, when executed by the onboard vehicle computer system causes the Advanced Driver Assistance System to operate the second DSRC-equipped vehicle to respond to the presence of the obstruction. The system where the Advanced Driver Assistance System operates the second DSRC-equipped vehicle to respond to the presence of the obstruction by modifying a heading of the second DSRC-equipped vehicle. The system where the Advanced Driver Assistance System operates the vehicle to respond to the presence of the obstruction by modifying a velocity of the second DSRC-equipped vehicle. The system where the Advanced Driver Assistance System operates the vehicle to respond to the presence of the obstruction by modifying an acceleration of the second DSRC-equipped vehicle. The system where the DSRC message is transmitted by a Roadside Unit. Implementations of the described techniques may include hardware, a method or process, or computer software on a computer-accessible medium.

One general aspect includes a computer program product including a non-transitory memory of an onboard vehicle computer system of a second DSRC-equipped vehicle storing computer-executable code that, when executed by a processor, causes the processor to: receive a DSRC message that includes path history data describing a path of a first DSRC-equipped vehicle with lane-level accuracy over a plurality of different times while the first DSRC-equipped vehicle is traveling on a roadway; determine a presence of an obstruction in a specific lane of the roadway based on the path history data, where the obstruction is indicated by the path history data because the path history data indicates that the obstruction affected the path of the first DSRC-equipped vehicle while traveling in the specific lane of the roadway; and provide a recommendation to a driver of the second DSRC-equipped vehicle, where the recommendation describes the presence of the obstruction in the specific lane of the roadway. Other embodiments of this aspect include corresponding computer systems, apparatus, and computer programs recorded on one or more computer storage devices, each configured to perform the actions of the methods.

Implementations may include one or more of the following features. The computer program product where providing the recommendation includes causing an electronic panel of the second DSRC-equipped vehicle to display a graphical message describing the presence of the obstruction in the specific lane of the roadway. The computer program product where providing the recommendation includes causing a speaker of the second DSRC-equipped vehicle to generate audio describing the presence of the obstruction in the specific lane of the roadway. Implementations of the described techniques may include hardware, a method or process, or computer software on a computer-accessible medium.

One general aspect includes a method including: receiving a wireless message that includes path history data describing a path of a first vehicle with lane-level accuracy over a plurality of different times while the first vehicle is traveling on a roadway; and determining, by a second vehicle, a presence of an obstruction in a specific lane of the roadway based on the path history data, where the obstruction is indicated by the path history data because the path history data indicates that the obstruction modified the path of the first vehicle while traveling in the specific lane of the roadway. Other embodiments of this aspect include corresponding computer systems, apparatus, and computer programs recorded on one or more computer storage devices, each configured to perform the actions of the methods.

Implementations may include one or more of the following features. The method where the wireless message is a full-duplex wireless message. The method where the wireless message is a DSRC message. The method where the wireless message is a basic safety message. The method where the path history data is generated by an onboard vehicle computer system of the first vehicle based on location data provided by a DSRC-compliant GPS unit of the first vehicle, where the location data provides the lane-level accuracy by describing the location of the second vehicle with an accuracy of substantially plus or minus 1.5 meters relative to the actual location of the second vehicle where the specific lane of the roadway is substantially 3 meters wide. The method where the obstruction modified the path of the first vehicle by causing the first vehicle to slow down. The method where the obstruction modified the path of the first vehicle by causing the first vehicle to change its heading. The method where the obstruction modified the path of the first vehicle by causing the first vehicle to change its acceleration. The method where the obstruction modified the path of the first vehicle by causing the first vehicle to swerve. Implementations of the described techniques may include hardware, a method or process, or computer software on a computer-accessible medium.

BRIEF DESCRIPTION OF THE DRAWINGS

The disclosure is illustrated by way of example, and not by way of limitation in the figures of the accompanying drawings in which like reference numerals are used to refer to similar elements.

FIG. 4A is a block diagram illustrating an example of BSM data according to some implementations.

FIG. 4B is a block diagram illustrating an example of BSM data according to some implementations.

DETAILED DESCRIPTION

Figure 1A:
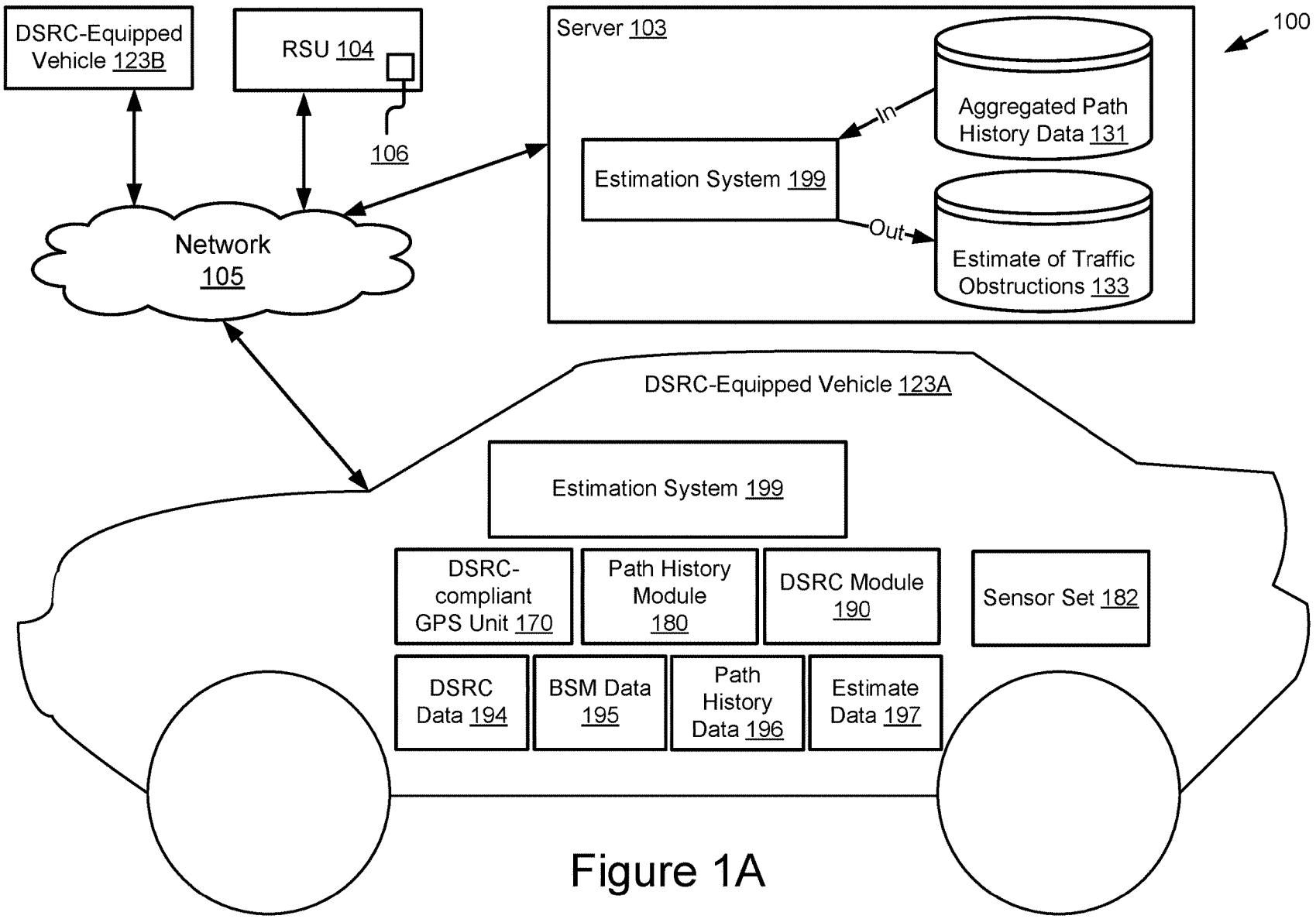
FIGS. 1A through 1C are block diagrams illustrating operating environments for one or more vehicles including an estimation system according to some implementations.

Assume that a vehicle is traveling down a roadway. The driver of the vehicle may observe an obstruction present in their specific lane of travel. For example, an ice patch may be present in their lane of travel. The driver may not see the ice patch. As a result, the vehicle may skid or swerve when it drivers over the ice patch, thereby affecting the path of travel for the vehicle. This may happen for many vehicles so that there is a pattern of vehicle paths being affected by the ice patch present in this specific lane of travel. It would be beneficial if vehicles could communicate with one another to provide warnings about the presence of such obstacles. The implementations of the estimation system described herein solve this problem.

In some implementations, the obstruction may include one or more of the following: one or more potholes; one or more vehicle wrecks; one or more bicycle wrecks; one or more pedestrian wrecks; one or more stalled vehicles; roadway construction or maintenance; one or more animals on the roadway (alive or dead); one or more people on the roadway; roadway debris; one or more ice patches; standing water on the roadway; and any other roadway condition that may affect, modify or impede traffic on the roadway.

In some implementations, the estimation system described herein may assist a driver of a vehicle by notifying them about the presence of obstacles present in a specific lane of a roadway using path history data encoded in one or more wireless messages. The one or more wireless messages may be received or aggregated by an onboard vehicle computer system of a vehicle, a RSU or a cloud server. Example implementations of the one or more wireless messages are described in more detail below.

Examples of a Notification

The notification provided to the driver of the vehicle may include a visual notification such as a graphical user interface ("GUI"), an audio notification such as audio generated by one or more speakers or a combination of a visual notification and an audio notification provided simultaneously or contemporaneously.

The visual notification may be provided by a heads-up display unit or an electronic panel. The heads-up display unit may include a three-dimensional heads-up display unit such as the one described in U.S. patent application Ser. No. 15/080,433 filed on Mar. 24, 2016 and entitled "Wireless Data Sharing Between a Mobile Client Device and a Three-Dimensional Heads-Up Display Unit," the entirety of which is herein incorporated by reference. The electronic panel may be an element of a head-unit or an infotainment system installed in the vehicle.

The audio notification may be provided by one or more speakers that are operated by the head-unit, infotainment system or navigation system of the vehicle.

Examples of a Wireless Message

Vehicles are increasingly equipped with DSRC. A vehicle equipped with DSRC may be referred to as "DSRC-equipped." A DSRC-equipped vehicle may include a DSRC antenna and any hardware of software necessary to send and receive DSRC messages, generate DSRC messages and read DSRC messages. For example, a DSRC-equipped vehicle may include any hardware or software necessary to receive a DSRC message, retrieve data included in the DSRC message and read the data included in the DSRC message.

The one or more wireless messages may include a DSRC message. There are many types of DSRC messages. One type of DSRC message is known as a BSM. DSRC-equipped vehicles broadcast a BSM at a regular interval. The interval may be user adjustable.

A BSM includes BSM data. The BSM data describes attributes of the vehicle that originally transmitted the BSM. Vehicles equipped with DSRC may broadcast BSMs at an adjustable rate. In some implementations, the rate may be once every 0.10 seconds. The BSM includes BSM data that describes, among other things, one or more of the following: (1) the path history of the vehicle that transmits the BSM; (2) the speed of the vehicle that transmits the BSM; and (3) the location data (sometimes referred to as "global positioning system data" or "GPS data") describing a location of the vehicle that transmits the BSM. FIGS. 4A and 4B depict examples of BSM data according to some implementations. FIGS. 4A and 4B are described below.

In some implementations, DSRC-equipped vehicles may probe other DSRC-equipped vehicles/devices along the roadway for information describing their current and future conditions, including their path history and future path. This information is described as "DSRC probe data." DSRC probe data may include any data received via a DSRC probe or responsive to a DSRC probe.

A DSRC message may include DSRC-based data. The DSRC-based data may include BSM data or DSRC probe data. In some implementations, the DSRC-based data included in a DSRC message may include BSM data or DSRC probe data received from a plurality of DSRC-equipped vehicles (or other DSRC-equipped devices). This BSM data or DSRC probe data may include an identifier of its source and the location of the source or any traffic events described by the BSM data or DSRC probe data.

In some implementations, the DSRC-enabled vehicles will include a DSRC-compliant GPS unit. The BSM data or DSRC probe data may specify which lane a vehicle is traveling in as well as its speed of travel and path history. The BSM data or DSRC probe data may further specify one or more of the following: a velocity of the vehicle at one or more different times or one or more different locations; a heading of the vehicle at one or more different times or one or more different locations; and an acceleration of the vehicle at one or more different times or one or more different locations.

Another type of wireless message is a full-duplex wireless message described in U.S. patent application Ser. No. 14/471,387 filed on Aug. 28, 2014 and entitled "Full-Duplex Coordination System," the entirety of which is herein incorporated by reference.

Examples of Lane Level Accuracy

Vehicles are also increasingly manufactured to include GPS-based navigation systems. A GPS-based navigation system may provide navigation routes to a driver that are based on location data and knowledge about queue lengths along roadways.

Lane level accuracy may mean that the location of a vehicle is described so accurately that the vehicle's lane of travel may be accurately determined. A conventional GPS system is unable to determine the location of a vehicle with lane-level accuracy. For example, a typical lane of a roadway is approximately 3 meters wide. However, a conventional GPS system may only have an accuracy of plus or minus 10 meters relative to the actual location of the vehicle.

A DSRC-compliant GPS unit can provide location data describing the location of a vehicle with lane-level accuracy. A DSRC-compliant GPS unit may include hardware that wirelessly communicates with a GPS satellite to retrieve location data that describes a location of a vehicle with a precision that is compliant with the DSRC standard. The DSRC standard requires that location data be precise enough to infer if two vehicles are in the same lane. The lane may be a lane of a roadway such as those depicted in FIGS. 1B and 1C. A DSRC-compliant GPS unit may be operable to identify, monitor and track its two-dimensional position within 1.5 meters of its actual position 68% of the time under an open sky. Since lanes of a roadway are typically no less than 3 meters wide, whenever the two dimensional error of the location data is less than 1.5 meters the estimation system described herein may analyze the location data provided by the DSRC-compliant GPS unit and determine what lane of the roadway the vehicle is traveling in based on the relative positions of vehicles on the roadway.

Described herein are implementations of an estimation system for providing an estimate of whether an obstruction is present in a particular lane of a roadway using wireless vehicle data that is included in a wireless message (e.g., a DSRC message, a BSM, a full-duplex wireless message, etc.).

Example Path History Data

Assume a vehicle is driving in a first lane of a roadway. The vehicle may be a DSRC-equipped vehicle. The vehicle may modify its heading, speed or acceleration, thereby modifying the path of the vehicle. For example, a driver of the vehicle may observe an obstruction present in the first lane of the roadway, and responsive to this observation, the driver may cause the vehicle to (1) slow down to a slower than normal driving speed while traveling in the first lane and before colliding with the obstruction, (2) steer to a second lane of the roadway before colliding with the obstruction and then (3) accelerate again to a normal driving speed to drive past the obstruction while traveling in the second lane. The vehicle may record path history data describing a path history of the vehicle while traveling. The path history may describe, for example, the steps described above for responding to the observation of the obstruction present in the first lane of the roadway.

In some implementations, the path history data may describe the location of the vehicle at different times. The information necessary for constructing such path history data is already included in BSMs. The estimation system described herein may makes use of this path history data to discern patterns among individual vehicles or groups of vehicles. The patterns may indicate a presence of a roadway obstruction present in a roadway or a particular lane of a roadway.

For example, a pattern in the path history data received from a group of vehicles may indicate that the group of vehicles may all swerve in a similar fashion whenever they reach the same (or approximately the same) geographic point on a roadway or the same (or approximately the same) geographic point in a particular lane of the roadway. This swerving may be assumed to be the result of a traffic obstruction. This pattern may be identified by the estimation system described herein. The estimation system may estimate the presence of a traffic obstruction present in the roadway or a specific lane of the roadway based on the identified pattern.

In some implementations, the path history data may describe one or more of the following for one or more vehicles: a series of times when a vehicle was traveling; a series of geographic locations where the vehicle was located at the different times (e.g., as indicated by location data sourced from a DSRC-compliant GPS unit); the velocity of the vehicle at the different times; the acceleration of the vehicle at the different times; a bearing or heading of the vehicle at the different times; vehicle kinematic data such vehicle brake status or any other vehicle kinematic data which may indicate a presence of an obstruction, and Advanced Driver Assistance System ("ADAS system") engagement information such as whether a vehicle traction control system or any other ADAS system of the vehicle is engaged and a description of the actions taken by the ADAS system.

The path history data may be a component of the BSM data as shown below in FIG. 4A or 4B. The path history data may also be a component of any other wireless message, such as a DSRC message or a full-duplex wireless message.

In some implementations, the path history data may be an element of the BSM data described below with reference to FIGS. 4A and 4B. The BSM data may be included in a BSM. The BSM may be transmitted or broadcasted via DSRC.

In some implementations, one or more of the elements of the BSM data may be included in a DSRC message or a full-duplex wireless message. For example, a DSRC message may include the path history data for a DSRC-equipped vehicle.

Example Deployment

In some implementations, the estimation system may work by vehicles transmitting wireless messages to one another, an RSU or a cloud server. A wireless message may include the path history data for the vehicle which originally transmitted the wireless message.

In some implementations, an estimation system of a vehicle may receive one or more wireless messages, aggregate the path history data included in these wireless messages and estimate a presence of an obstruction based on the aggregated path history data.

In some implementations, a RSU may aggregate the path history data. The RSU may include an estimation system. The estimation system may provide batches of aggregated path history data to vehicles that are within transmission range of the RSU so that they may receive a wireless message from the RSU including a batch of aggregated path history data collected from a plurality of vehicles. The transmission range may include DSRC range, Wi-Fi range, full-duplex wireless communication range or any other range for a wireless message.

Optionally, the RSU may transmit the batched path history data to a cloud server. The cloud server may then provide path history data to one or more vehicles via a mobile data network that may include third-generation (3G), fourth-generation (4G), long-term evolution (LTE), Voice-over-LTE ("VoLTE") or any other mobile data network or combination of mobile data networks. See, for example, network 105 described below with reference to FIG. 1A.

ADAS System

Examples of an ADAS system may include one or more of the following elements of a vehicle: an adaptive cruise control ("ACC") system; an adaptive high beam system; an adaptive light control system; an automatic parking system; an automotive night vision system; a blind spot monitor; a collision avoidance system; a crosswind stabilization system; a driver drowsiness detection system; a driver monitoring system; an emergency driver assistance system; a forward collision warning system; an intersection assistance system; an intelligent speed adaption system; a lane departure warning system; a pedestrian protection system; a traffic sign recognition system; a turning assistant; and a wrong-way driving warning system.

The ADAS system may also include any software or hardware included in a vehicle that makes that vehicle be an autonomous vehicle or a semi-autonomous vehicle.

In some implementations, the engagement or activities of an ADAS system may be included in the path history data.

In some implementations, the estimation system may estimate the presence of an obstruction and provide a signal to the ADAS system that describes the obstruction. The ADAS system may control the operation of the vehicle to respond to the presence of the obstruction. The response may include avoiding the obstruction, attempting to avoid the obstruction, minimizing the effect of the obstruction on the vehicle or mitigating the effect of the obstruction on the vehicle.

Example Overview

Figure 1B:
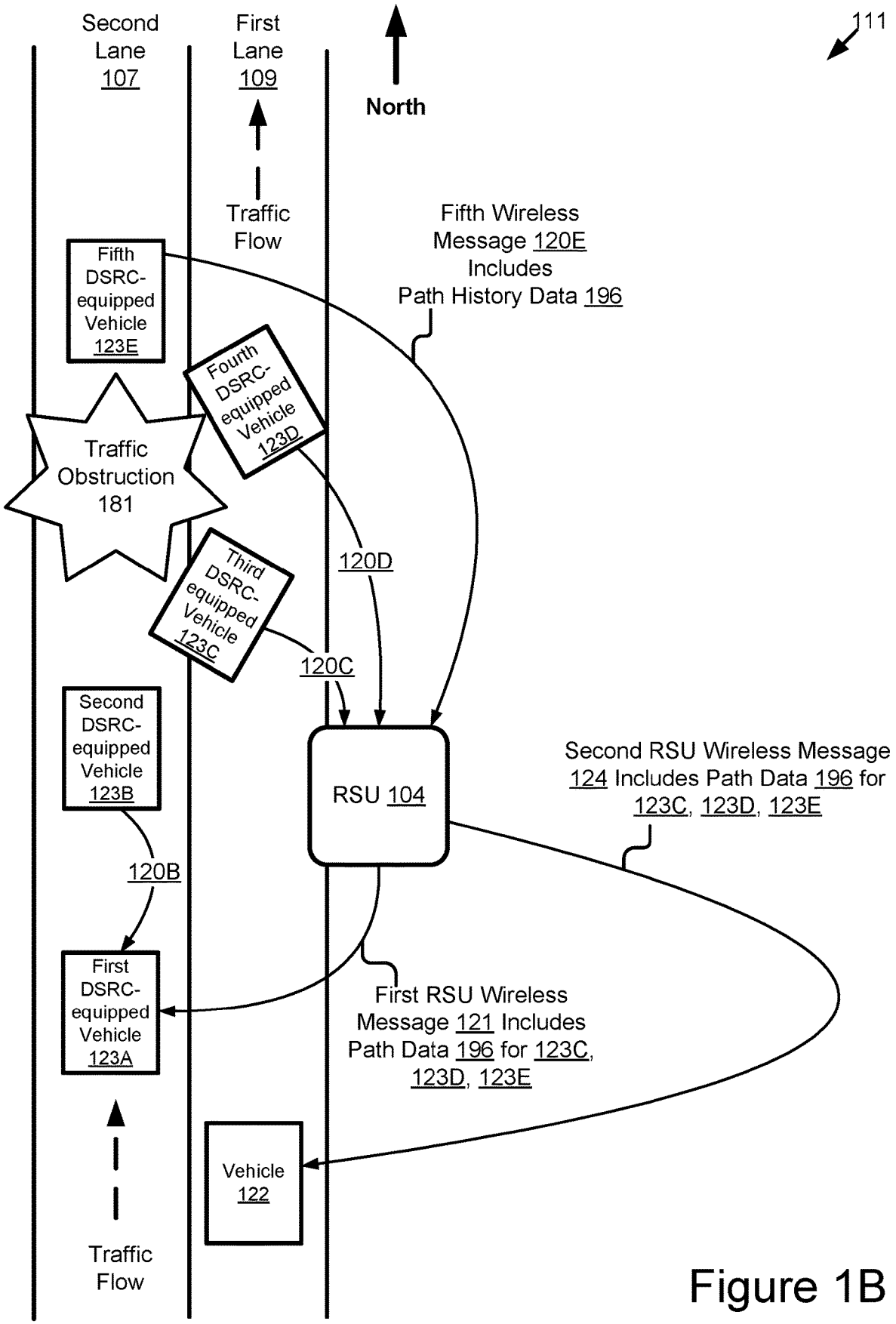
Figure 1C:
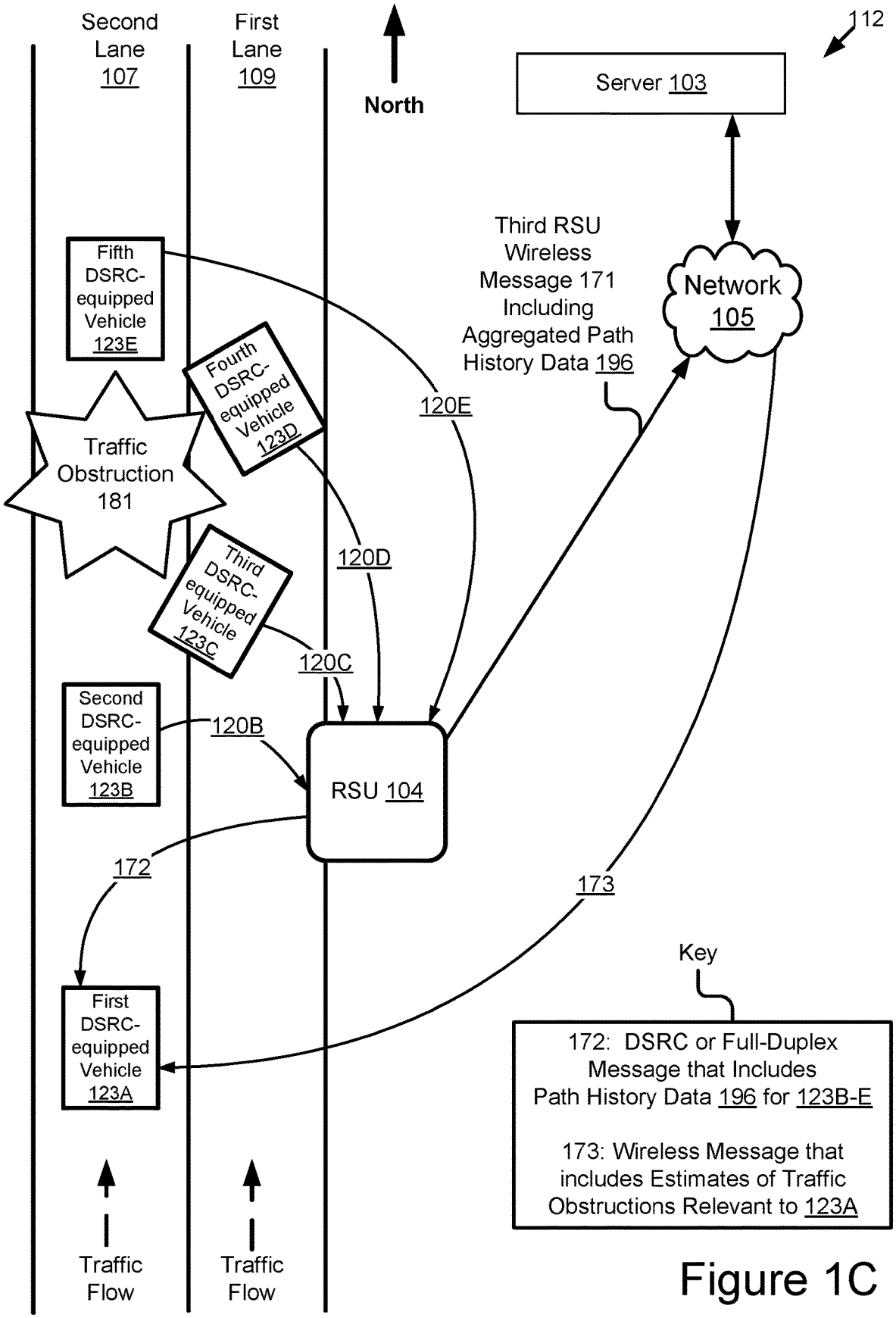

FIGS. 1A through 1C are block diagrams illustrating example operating environments 100, 111, 112 for an estimation system 199 according to some implementations.

Referring to FIG. 1A, the operating environment 100 may include one or more of the following elements: a first DSRC-equipped vehicle 123A; a second DSRC-equipped vehicle 123B; a roadside unit 104 ("RSU 104"); and a server 103. These elements of the operating environment 100 may be communicatively coupled to a network 105.

In some implementations, the server 103 may be an element of the RSU 104. In some implementations, the server 103 may be a separate element. For example, the server 103 may be a server or some other processor-based computing device that is operable to send and receive messages via the network 105. The RSU 104 and the server 103 are described in more detail below.

The network 105 may be a conventional type, wired or wireless, and may have numerous different configurations including a star configuration, token ring configuration, or other configurations. Furthermore, the network 105 may include a local area network (LAN), a wide area network (WAN) (e.g., the Internet), or other interconnected data paths across which multiple devices and/or entities may communicate. In some implementations, the network 105 may include a peer-to-peer network. The network 105 may also be coupled to or may include portions of a telecommunications network for sending data in a variety of different communication protocols. In some implementations, the network 105 includes Bluetooth® communication networks or a cellular communications network for sending and receiving data including via short messaging service (SMS), multimedia messaging service (MMS), hypertext transfer protocol (HTTP), direct data connection, wireless application protocol (WAP), e-mail, DSRC, full-duplex wireless communication, etc. The network 105 may also include a mobile data network that may include 3G, 4G, LTE, VoLTE or any other mobile data network or combination of mobile data networks. Further, the network 105 may include one or more IEEE 802.11 wireless networks.

In some implementations, the network 105 may include one or more communication channels shared among the DSRC-equipped vehicle 123 and one or more other wireless communication devices (e.g., other vehicles 123B, the RSU 104, the server 103, etc.). The communication channel may include DSRC, full-duplex wireless communication or any other wireless communication protocol. For example, the network 105 may be used to transmit a DSRC message, DSRC probe or BSM to a DSRC-equipped vehicle 123.

The first DSRC-equipped vehicle 123A and the second DSRC-equipped vehicle 123B may include the same or similar elements. The first DSRC-equipped vehicle 123A and the second DSRC-equipped vehicle 123B may be referred to collectively as "the DSRC-equipped vehicles 123" or individually as "the DSRC-equipped vehicle 123." The first DSRC-equipped vehicle 123A may be referred to as a "second DSRC-equipped vehicle" or the second DSRC-equipped vehicle 123B may be referred to as a "first DSRC-equipped vehicle."

The first DSRC-equipped vehicle 123A may include a car, a truck, a sports utility vehicle, a bus, a semi-truck, a drone or any other roadway-based conveyance. In some implementations, the first DSRC-equipped vehicle 123A may include an autonomous vehicle or a semi-autonomous vehicle. For example, the first DSRC-equipped vehicle 123A may include an ADAS system.

The first DSRC-equipped vehicle 123A may include one or more of the following elements: an estimation system 199; a DSRC-compliant GPS unit 170; a path history module 180; a DSRC module 190 and a sensor set 182. The first DSRC-equipped vehicle 123A may further include a non-transitory memory (not pictured) that stores one or more of the following elements: DSRC data 194; BSM data 195; path history data 196; estimate data 197; the estimation system 199; the DSRC-compliant GPS unit 170; the path history module 180; and the DSRC module 190.

Although not pictured in FIG. 1A, in some implementations the first DSRC-equipped vehicle 123A may include an onboard vehicle computer system that is communicatively coupled to the estimation system 199 and the non-transitory memory. The onboard vehicle computer system may be operable to cause or control the operation of the estimation system 199. The onboard vehicle computer system may be operable to access and execute the data stored on the non-transitory memory. For example, the onboard vehicle computer system may be operable to access and execute one or more of the following: the estimation system 199; the DSRC-compliant GPS unit 170; the path history module 180; the DSRC module 190; the DSRC data 194; the BSM data 195; the path history data 196; the estimate data 197; and the sensor set 182.

In some implementations, the estimation system 199 may include code or routines that build a wireless message that includes any data that is needed for another DSRC-equipped vehicle 123 (e.g., the second DSRC-equipped vehicle 123B) to provide a driver with a notification about the presence of an obstruction on the roadway (or a specific lane of the roadway). For example, the estimation system 199 may include code and routines that are operable to build a wireless message that includes the path history data 196. The wireless message may include a DSRC message, a DSRC probe, a BSM or a full-duplex wireless message.

In some implementations, the estimation system 199 may include code and routines that are operable to receive path history data 196 from the path history module 180. The path history module 180 is described below. In some elements the path history module 180 may be an element of the estimation system 199. The estimation system 199 may generate a wireless message that includes the path history data 196. The estimation system 199 may transmit the wireless message to directly to another DSRC-equipped vehicle 123B or the RSU 104 via a DSRC message, BSM or a full-duplex wireless communication.

In some implementations, the estimation system 199 may transmit the wireless message to the network 105. One or more of the DSRC-equipped vehicle 123, the RSU 104, and the server 103 may receive the wireless message from the network 105.

In this way, the estimation system 199 may beneficially provide one or more other vehicles (e.g., one or more second DSRC-equipped vehicles 123B, assuming the estimation system is an element of the first DSRC-equipped vehicle 123A) with path history data 196 describing the path history of the DSRC-equipped vehicle 123 for which the estimation system 199 is an element (e.g., the first DSRC-equipped vehicle 123A).

The estimation system 199 may beneficially determine the presence of obstructions present in the roadway (or a specific lane of the roadway) based on path history data 196 included in one or more wireless messages transmitted by one or more other vehicles (e.g., one or more second DSRC-equipped vehicles 123B, assuming that the estimation system 199 is an element of the first DSRC-equipped vehicle 123A). For example, the estimation system 199 may include code and routines that are operable to analyze a wireless message including path history data 196. The wireless message may be received via a DSRC message, a BSM or a full-duplex message. In some implementations, the wireless message may be received from the network 105.

In some implementations, the estimation system 199 may parse the path history data 196 from the wireless message. The estimation system 199 may analyze the path history data 196 to identify one or more patterns described by the path history data 196 for one or more other vehicles (e.g., one or more second DSRC-equipped vehicles 123B, assuming the estimation system 199 is an element of the first DSRC-equipped vehicle 123A). The patterns may include, for example, modifications to the paths of one or more other vehicles at a similar geographic location on a roadway (or s similar geographic location in a specific lane of the roadway).

For example, a single wireless message may include the path history data 196 for a single DSRC-equipped vehicle 123 and the estimation system 199 may receive a plurality of sets of path history data 196 from a plurality of DSRC-equipped vehicles 123 so that the estimation system 199 may identify one or more patterns in the path history of the plurality of DSRC-equipped vehicles 123B. The one or more patterns may indicate a presence of an obstruction present on the roadway (or a particular lane of the roadway). For example, the DSRC-equipped vehicles 123B described by the plurality of sets of path history data 196 may have a pattern of modifying one or more of their velocity, acceleration or heading at a same or similar geographic location (see, e.g., FIG. 1B or FIG. 1C). In this way the estimation system 199 may estimate a presence of an obstruction as being present at the geographic location where the DSRC-equipped vehicles 123B described by the plurality of sets of path history data 196 modify one or more of their velocity, acceleration or heading.

In another example, a device such as a DSRC-equipped vehicle 123, RSU 104 or server 103 may aggregate path history data 196 from received in wireless messages transmitted by a plurality of DSRC-equipped vehicles 123 to (1) form a batch of path history data 196 and (2) transmit a wireless message that includes a batch of path history data 196 from the plurality of DSRC-equipped vehicles 123. The estimation system 199 may receive the wireless message that includes the batch of path history data 196 from the plurality of DSRC-equipped vehicles 123. The estimation system 199 may identify patterns in the path history of the plurality of DSRC-equipped vehicles 123. The one or more patterns may indicate a presence of an obstruction present on the roadway (or a particular lane of the roadway). For example, the DSRC-equipped vehicles 123 described by the batch of path history data 196 may have a pattern of modifying one or more of their velocity, acceleration or heading at a same or similar geographic location. In this way the estimation system 199 may estimate a presence of an obstruction as being present at the geographic location where the DSRC-equipped vehicles 123 described by the batch of path history data 196 modify one or more of their velocity, acceleration or heading.

In some implementations, the estimation system 199 may be an element of the DSRC-equipped vehicle 123, RSU 104 or server 103 that aggregates the path history data 196 to form the batch of path history data 196. The estimation system 199 may generate a wireless message that includes the batch of path history data 196. The estimation system 199 may transmit the wireless message to a DSRC-equipped vehicle 123, RSU 104, server 103 or the network 105 via DSRC, BSM, full-duplex wireless communication, Wi-Fi, 3G, 4G, LTE, VoLTE or some other form of wireless communication.

In some implementations, the estimation system 199 may be implemented using hardware including a field-programmable gate array ("FPGA") or an application-specific integrated circuit ("ASIC"). In some other implementations, the estimation system 199 may be implemented using a combination of hardware and software. The estimation system 199 may be stored in a combination of the devices (e.g., servers or other devices), or in one of the devices.

The estimation system 199 will be described in more detail below with reference to FIGS. 1B, 1C, 2, 3A and 3B.

The DSRC-compliant GPS unit 170 may include hardware that wirelessly communicates with a GPS satellite to retrieve location data that describes a location of the DSRC-equipped vehicle 123. In some implementations, a DSRC-compliant GPS unit 170 is operable to provide location data that describes the location of the DSRC-equipped vehicle 123 to a lane-level degree of precision. The DSRC standard requires that location data be precise enough to infer if two vehicles (such as DSRC-equipped vehicle 123 and another vehicle on the same roadway as the DSRC-equipped vehicle 123) are in the same lane. The lane may be a lane of a drive-through such as those depicted in FIGS. 1B and 1C. The DSRC-compliant GPS unit 170 may be operable to identify, monitor and track its two-dimensional position within 1.5 meters of its actual position 68% of the time under an open sky. Since lanes of a roadway are typically no less than 3 meters wide, whenever the two dimensional error of the location data is less than 1.5 meters the estimation system 199 may analyze the location data provided by the DSRC-compliant GPS unit 170 and determine what lane of the roadway the DSRC-equipped vehicle 123 is traveling in based on the relative positions of vehicles on the roadway.

For example, referring now to FIG. 1B, the estimation system 199 may analyze the location data generated by the DSRC-compliant GPS unit 170 included in the second DSRC-equipped vehicle 123B and determine that the second DSRC-equipped vehicle 123B is traveling in the second lane 107 based on the location data for the second DSRC-equipped vehicle 123B. In some implementations, this analysis by the estimation system 199 may include comparing the location of the second DSRC-equipped vehicle 123B as described by the location data provided by the second DSRC-equipped vehicle 123B (which may be an element of the path history data 196 for the second DSRC-equipped vehicle 123B) relative to the location data provided by another vehicle such as the third DSRC-equipped vehicle 123C (which may be an element of the path history data 196 for the third DSRC-equipped vehicle 123C). In this way the DSRC-compliant GPS unit 170 may beneficially enable the estimation system 199 to determine which lanes different DSRC-equipped vehicles 123 are traveling in.

By comparison, a GPS unit which is not compliant with the DSRC standard is far less accurate than the DSRC-compliant GPS unit 170 and not capable of reliably providing lane-level accuracy, as is the DSRC-compliant GPS unit 170. For example, a non-DSRC-compliant GPS unit may have an accuracy on the order of 10 meters, which is not sufficiently precise to provide the lane-level degree of precision provided by the DSRC-compliant GPS unit 170. For example, since a lane may be as narrow as 3 meters wide, the DSRC standard may require a DSRC-compliant GPS unit 170 to have an accuracy on the order of 1.5 meters, which is significantly more precise than a non-DSRC-compliant GPS unit as described above. As a result, a non-DSRC-compliant GPS unit may not be able to provide location data that is accurate enough for the estimation system 199 (or the path history module 180) to generate accurate path history data 196 for the first DSRC-equipped vehicle 123A or determine a presence of an obstruction in a particular lane of the roadway (such as the second lane 107). The imprecision of a non-DSRC-compliant GPS unit may therefore render the functionality of the estimation system 199 inoperable.

Referring now to FIG. 1A, in some implementations the location data retrieved by the DSRC-compliant GPS unit 170 may be an element of the path history data 196, the DSRC data 194 or the BSM data 195. Optionally, the location data may be stored as sensor data or some other data on the non-transitory memory of the DSRC-equipped vehicle 123.

Figure 2:
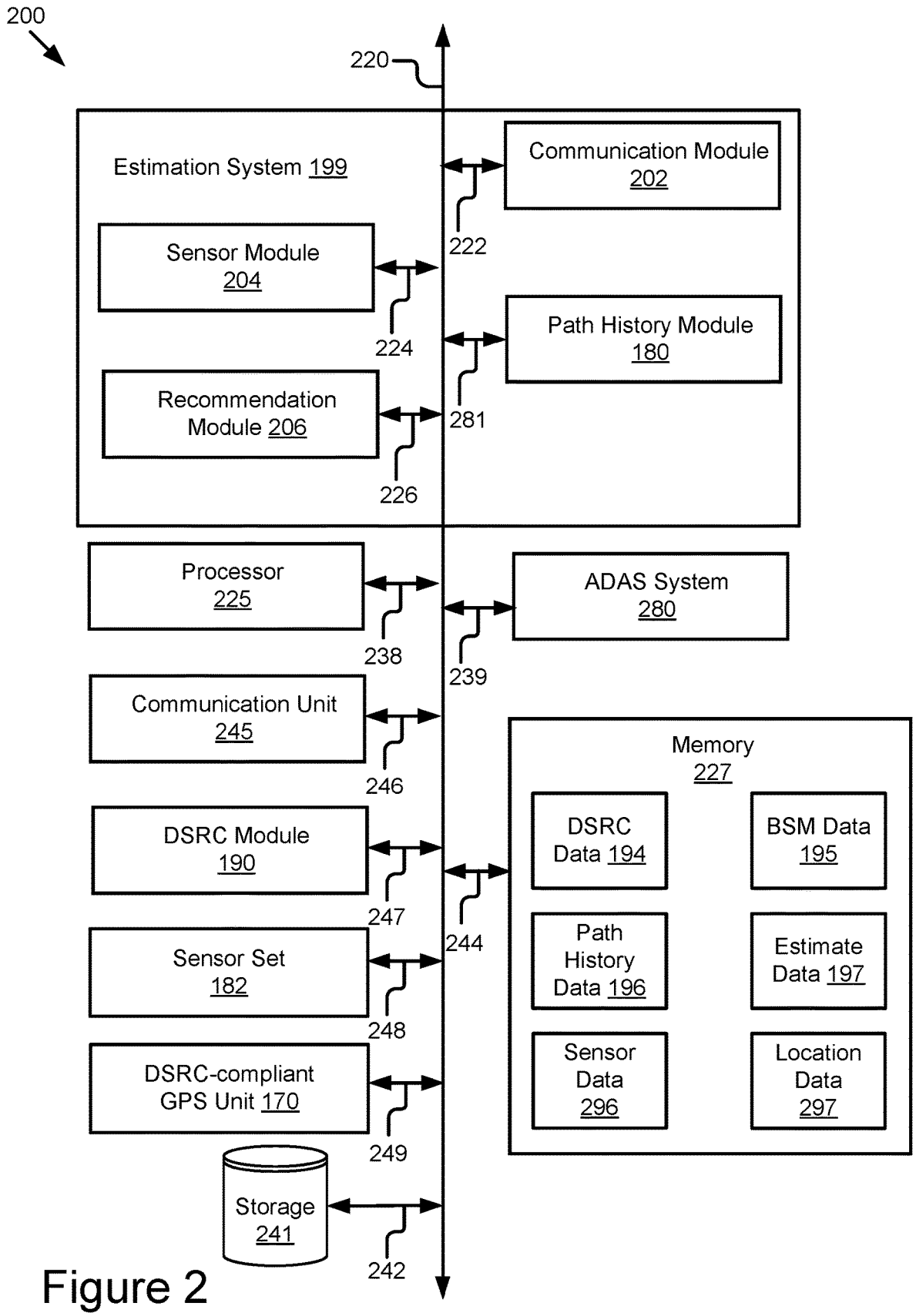
FIG. 2 is a block diagram illustrating an example computer system including an estimation system according to some implementations.

In some implementations, the location data may be an independent element that is stored on the non-transitory memory of the DSRC-equipped vehicle 123 (see, e.g., location data 297 depicted in FIG. 2).

Still referring to FIG. 1A, the path history module 180 may include code and routines that are operable to generate the path history data 196. For example, the DSRC-equipped vehicle 123 may include a sensor set 182. The sensor set 182 may include one or more sensors. The sensor set 182 may collect sensor data (see, e.g., sensor data 296 depicted in FIG. 2). The sensor data may describe, for example, one or more of the following: a series of times when the DSRC-equipped vehicle 123 is traveling; a series of geographic locations where the DSRC-equipped vehicle 123 was located at the different times (e.g., as indicated by location data sourced from a DSRC-compliant GPS unit 170); the velocity of the DSRC-equipped vehicle 123 at the different times; the acceleration of the DSRC-equipped vehicle 123 at the different times; a bearing or heading of the DSRC-equipped vehicle 123 at the different times; vehicle kinematic data such the brake status of the DSRC-equipped vehicle 123 or any other vehicle kinematic data which may indicate a presence of an obstruction; and ADAS system engagement information such as whether a vehicle traction control system or any other ADAS system of the DSRC-equipped vehicle 123 is engaged and a description of the actions taken by the ADAS system (e.g., the ADAS system 280 of FIG. 2). In this way, the sensor data may describe the behavior of the DSRC-equipped vehicle 123 at the different times and at different locations and this behavior may indicate a presence of an obstruction on the roadway (or in a specific lane of the roadway). If other vehicles behave similarly at similar locations, then this may create a pattern that may indicate a presence of an obstruction on the roadway (or in a specific lane of the roadway). If more vehicles behave similarly at similar geographic locations, then the estimation system 199 may generate a confidence factor indicating a greater confidence that an obstruction is present at that geographic location.

In some implementations, the path history module 180 may analyze one or more of the sensor data and the location data. The path history module 180 may generate the path history data 196 based on one or more of the sensor data and the location data. The location data may be an element of the sensor data. The location data may be time stamped. For example, the location data may describe the location of the DSRC-equipped vehicle 123 at different points in time.

In some implementations, the path history data 196 may describe the location of the DSRC-equipped vehicle 123A at different points in time. For example, the path history module 180 may analyze the location data that describes the location of the DSRC-equipped vehicle 123 with lane-level precision at different points in time. The path history module 180 may generate the path history data 196 based in part on the location data.

In some implementations, the path history data 196 may include one or more entries. An entry may describe the location of the DSRC-equipped vehicle at a point in time.

In some implementations, each entry in the path history data 196 may include a data set formed from a location/time pair, i.e., (location, time). The location included in each data set may be the GPS coordinates of the DSRC-equipped vehicle 123 at a given time. The time included in each data set may optionally be a Universal Time value (UT) that is common to all systems and subsystems that use the path history data 196.

A first DSRC-equipped vehicle 123A may be present on a roadway. The first DSRC-equipped vehicle 123A may receive a wireless message such as a DSRC message, DSRC probe, BSM, full-duplex wireless message or some other wireless message. The wireless message may include path history data 196 for another device such as a second DSRC-equipped vehicle 123B that is present in a drive-through of a drive-through business. The second DSRC-equipped vehicle 123B may be present on a roadway. The path history data 196 may describe one or more locations of the second DSRC-equipped vehicle 123B at one or more points in time on the roadway. The first DSRC-equipped vehicle 123A may be traveling on the same roadway at the same time as the second DSRC-equipped vehicle 123B or contemporaneous to the second DSRC-equipped vehicle 123A.

In some implementations, the estimation system 199 of the first DSRC-equipped vehicle 123A may generate estimate data 197 based on the path history data 196 of the second DSRC-equipped vehicle 123B. The estimate data 197 may describe an estimate of whether there is an obstruction present on the roadway. For example, the second DSRC-equipped vehicle 123B and the first DSRC-equipped vehicle 123A are present on the same roadway contemporaneously with the second DSRC-equipped vehicle 123B being ahead from the first DSRC-equipped vehicle 123A (e.g., down the road and traveling in the same heading as the first DSRC-equipped vehicle 123A). In this way, the path history data 196 of the second DSRC-equipped vehicle 123B may describe a path of the second DSRC-equipped vehicle 123B, and this path may indicate a presence of a roadway obstruction on the roadway. Since the second DSRC-equipped vehicle 123B may include a DSRC-compliant GPS unit 170, the path history data 196 of the second DSRC-equipped vehicle 123B may indicate a presence of an obstruction in a particular lane of the roadway.

In some implementations, the estimation system 199 may receive a plurality of wireless messages including a plurality of different sets of path history data 196 from a plurality of other vehicles. Alternatively, the estimation system 199 may receive a single wireless message including a batch of path history data 196 for a plurality of vehicles. The batch may include a plurality of sets of path history data 196 for a plurality of vehicles.

In some implementations, the estimation system 199 may generate the estimate data 197 based on the plurality of different sets of path history data 196.

In some implementations, the estimation system 199 may generate a confidence factor (e.g., scale of 1 to 10 or some other scale) associated with the estimate data 197. For example, if the path history data 196 of multiple vehicles indicates the presence of an obstruction at a same or similar geographic location, then the confidence factor may indicate a higher confidence that the obstruction is present at the geographic location.

In some implementations, the estimation system 199 may provide a recommendation to a driver of the first DSRC-equipped vehicle 123A based on the estimate data 197. The recommendation may describe the estimate of whether there is an obstruction present on the roadway (or a particular lane of the roadway). The recommendation may describe a suggested response to the obstruction. For example, the suggested response may include changing lanes or otherwise changing the heading of the first DSRC-equipped vehicle 123A, changing the velocity of the first DSRC-equipped vehicle 123A, changing the acceleration of the first DSRC-equipped vehicle 123A or changing a navigation route of the first DSRC-equipped vehicle 123A. In this way, the estimation system 199 may beneficially improve the performance of the first DSRC-equipped vehicle 123A by assisting the driver of the first DSRC-equipped vehicle 123A to avoid the traffic obstruction, minimize the effect of the traffic obstruction or mitigate the effect of the traffic obstruction.

In some implementations, the recommendation may describe the confidence factor so that the driver may access whether to trust the recommendation or the estimate data 197. In some implementations, the driver is not notified unless the confidence factor meets or exceeds some predetermined threshold.

In some implementations, the estimation system 199 may provide a signal to an ADAS system of the first DSRC-equipped vehicle 123A and the ADAS system may control one or more operations of the first DSRC-equipped vehicle 123A to avoid the traffic obstruction, minimize the effect of the traffic obstruction or mitigate the effect of the traffic obstruction. The signal may be encoded to include the estimate data 197 or the path history data 196 used to generate the estimate data 197. In this way, the estimation system 199 may beneficially improve the performance of the ADAS system may enabling the ADAS system to have access to path history data 196 of another vehicle which it would not otherwise be able to access.

In some implementations, the signal may be encoded to include the confidence factor. The ADAS system may be operable so that it does not act on the data included in the signal unless the confidence factor meets or exceeds some predetermined threshold.

In some implementations, the estimation system 199 may include code and routines that are operable to collect path history data 196 built by the path history module 180, generate one or more wireless messages that are encoded to include the path history data 196 and transmit the wireless message to another device such as the second DSRC-equipped vehicle 123B, the RSU 104 or the server 103. The wireless message may include a BSM, DSRC message, full-duplex wireless message or any other wireless message.

The sensor set 182 may include one or more sensors that are operable to measure the physical environment outside of the DSRC-equipped vehicle 123. For example, the sensor set 182 may record one or more physical characteristics of the physical environment that is proximate to the DSRC-equipped vehicle 123.

In some implementations, the sensor set 182 may include one or more of the following vehicle sensors: a camera; a LIDAR sensor; a laser altimeter; a navigation sensor (e.g., a global positioning system sensor of the DSRC-compliant GPS unit 170); an infrared detector; a motion detector; a thermostat; a sound detector, a carbon monoxide sensor; a carbon dioxide sensor; an oxygen sensor; a mass air flow sensor; an engine coolant temperature sensor; a throttle position sensor; a crank shaft position sensor; an automobile engine sensor; a valve timer; an air-fuel ratio meter; a blind spot meter; a curb feeler; a defect detector; a Hall effect sensor, a manifold absolute pressure sensor; a parking sensor; a radar gun; a speedometer; a speed sensor; a tire-pressure monitoring sensor; a torque sensor; a transmission fluid temperature sensor; a turbine speed sensor (TSS); a variable reluctance sensor; a vehicle speed sensor (VSS); a water sensor; a wheel speed sensor; and any other type of automotive sensor.

The sensor set 182 may be operable to record sensor data that describes one or more locations of the DSRC-equipped vehicle 123 at one or more different times. An example of the sensor data is depicted in FIG. 2 as sensor data 296.

The DSRC module 190 may include a DSRC antenna. The DSRC antenna may include a DSRC transceiver and a DSRC receiver. The DSRC module 190 may be configured to broadcast a BSM at some fixed interval (every 10 to 15 seconds) that is user configurable.

In some implementations, the DSRC module 190 is an element of a communication unit 245 that is described in more detail below with reference to FIG. 2.

The DSRC data 194 may include any data that is included or encoded in a DSRC message or a DSRC probe. The DSRC data 194 may include one or more of the following: one or more elements of the BSM data 195; the path history data 196; the sensor data; and the estimate data 197.

In some implementations, the DSRC data 194 may include BSM data 195, path history data 196, sensor data or estimate data 197 that is received from other DSRC-equipped vehicles 123. For example, the first DSRC-equipped vehicle 123A may receive DSRC messages from one or more second DSRC-equipped vehicles 123B that describes the path history data 196 of these other DSRC-equipped vehicles 123B and this information may be aggregated for retransmission to other DSRC-equipped devices (e.g., the second DSRC-equipped vehicle 123B, an RSU 104, etc.).

The BSM data 195 may include any data that is included or encoded in a BSM. The BSM data 195 is described in more detail below with reference to FIGS. 4A and 4B.

Although not depicted in FIG. 1A, in some implementations the DSRC-equipped vehicle 123 may include a full-duplex coordination system as described in U.S. patent application Ser. No. 14/471,387 filed on Aug. 28, 2014 and entitled "Full-Duplex Coordination System."

In some implementations, the full-duplex coordination system of the DSRC-equipped vehicle 123 may receive a full-duplex wireless message that includes path history data 196. The estimation system 199 may determine estimate data 197 based on the path history data 196.

The DSRC-equipped vehicle 123 may be communicatively coupled to the network 105.

The server 103 may include a processor based computing device. For example, the computing device may include a standalone hardware server. In some implementations, the server 103 may be communicatively coupled to the network 105. The server 103 may include network communication capabilities. The server 103 may be operable to send and receive wireless messages via the network 105. For example, the computing device may include a communication unit (such as described below with reference to the communication unit 245 of FIG. 2). The computing device may be operable to send and receive DSRC messages, BSM, full-duplex wireless messages or any other wireless message.

In some implementations, the first DSRC-equipped vehicle 123A may provide the path history data 196 to the server 103 via the network 105. For example, the DSRC-equipped vehicle 123A may transmit a wireless message to the server 103 via the network 105. The wireless message may include the path history data 196 for the first DSRC-equipped vehicle 123A, and possibly other DSRC-equipped vehicles that have transmitted their path history data 196 to the first DSRC-equipped vehicle 123A. One or more other DSRC-equipped vehicles may also transmit their path history data 196 to the server 103 via the network 105. The server 103 may store and aggregate the path history data 196 received via the network 105 in a non-transitory memory to form the aggregated path history data 131.

The aggregated path history data 131 may include one or more sets of path history data 196 for one or more vehicles (e.g., the first DSRC-equipped vehicle 123A, the second DSRC-equipped vehicle 123B, and any other vehicles, which may be DSRC-equipped or not).

The aggregated path history data 131 may include one or more sets of path history data 196.

The estimation system 199 of the server 103 may include code and routines that are operable to receive the aggregated path history data 131 and output the estimate of traffic obstructions 133. The estimate of traffic obstructions may include a set of estimate data 197 for each set of path history data 196 included in the aggregated path history data 131. The sets of estimate data 197 included in the estimate of traffic obstructions 133 may be indexed based on the geographic location included in the particular set of path history data 196 that is used to generate the set of estimate data 197.

In some implementations, the server 103 may provide the one or more sets of estimate data 197 to one or more vehicles such as the DSRC-equipped vehicles 123 or one or more non-DSRC-equipped vehicles that include network communication capabilities so that they are operable to receive a set of estimate data 197 from the server 103 via the network 105. For example, a vehicle (e.g., the first DSRC-equipped vehicle 123A) may include an estimation system 199 that transmits a request for estimate data 197 that includes location data describing the geographic location of the requesting vehicle provide their location data to the server 103 via the network 105. The estimation system 199 of the server 103 may identify the set of estimate data 197 from the estimate of traffic obstructions 133 that corresponds to the location data included in the request. The estimation system 199 of the server 103 may reply to the request with a wireless message that includes the set of estimate data 197 that is relevant to the geographic location included in the request. In this way, the estimation system 199 of the vehicle may identify the obstructions that are relevant to the current geographic location of the vehicle using data sourced from a cloud server such as the server 103 in this example.

The RSU 104 may include a relay module 106. The RSU 104 may include a communication unit such as communication unit 245 described below with reference to FIG. 2. The RSU 104 may receive wireless messages from one or more vehicles that include path history data 196. The relay module 106 may include code and routines that are operable to receive path history data 196 from one or more vehicles and they relay this information to the server 103 via the network 105. In this way, the RSU 104 may assist the server 103 to aggregate path history data 196 to build the aggregated path history data 131. An example of this implementations is described below with reference to FIG. 1C.

In some implementations, the second DSRC-equipped vehicle 123B may include elements that are similar to the first DSRC-equipped vehicle 123A, and so, those descriptions will not be repeated here.

In some implementations, the operating environment 100 may include a plurality of DSRC-equipped vehicles 123 that each include an estimation system 199 and other elements that are similar to those described above for the first DSRC-equipped vehicle 123A or the server 103. An example of an operating environment including a plurality of DSRC-equipped vehicles 123 that each include an estimation system 199 and other elements that are similar to those described above for the DSRC-equipped vehicles is shown in FIGS. 1B and 1C.

Referring now to FIG. 1B, depicted is a block diagram illustrating an example operating environment 111 for a plurality of DSRC-equipped vehicles 123A, 123B, 123C, 123D, 123E each including an estimation system 199 that is not pictured in FIG. 1B (e.g., a first estimation system 199A, a second estimation system 199B, a third estimation system 199C, a fourth estimation system 199D, a fifth estimation system 199E for each of the DSRC-equipped vehicles 123A, 123B, 123C, 123D, 123E, respectively), according to some implementations. Each of the DSRC-equipped vehicles 123A, 123B, 123C, 123D, 123E may include elements that are similar to those described above for the first DSRC-equipped vehicle 123A, and so, those descriptions will not be repeated here.

In some implementations, the DSRC-equipped vehicles 123A, 123B, 123C, 123D, 123E may be of the same make (e.g., Toyota) so that the functionality described herein is only available to DSRC-equipped vehicles 123A, 123B, 123C, 123D, 123E of that make.

The operating environment 111 may also include a plurality of non-DSRC-equipped vehicles such as the vehicle 122. These vehicles 122 may include a car, bus, semi-truck, drone, or any other conveyance that is configured to operate on a roadway. These vehicles 122 may be referred to collectively as "vehicles 122" or individually as "a first vehicle 122A," "a second vehicle 122B" and "a third vehicle 122C." The vehicles 122 do not include a DSRC module 190 or any capability to communicate via DSRC.

The operating environment 111 may include a roadway. The roadway may include a first lane 109 and a second lane 107. In the depicted implementation, the roadway is configured so that traffic using the roadway travels in a substantially north-bound heading in both the first lane 109 and the second lane 107. In other implementations, the roadway may be configured so that traffic travels in other directions than those depicted in FIG. 1B. The roadway may also include different lanes than those depicted in FIG. 1B.

FIG. 1B is not drawn to scale. In some implementations, each of the first lane 109 and the second lane 107 are substantially 3 meters wide.

The second lane 107 may include a first DSRC-equipped vehicle 123A, a second DSRC-equipped vehicle 123B and a fifth DSRC-equipped vehicle 123E. The second lane 107 also includes a traffic obstruction 181 which the third-DSRC-equipped vehicle 123C and the fourth DSRC-equipped vehicle 123D are trying to avoid by swerving into the first lane 109. The fifth DSRC-equipped vehicle 123E may have already avoided the traffic obstruction 181 in a manner similar to the third DSRC-equipped vehicle 123C and the fourth DSRC-equipped vehicle 123D.

The fifth DSRC-equipped vehicle 123E may transmit a fifth wireless message 120E to the RSU 104. The fifth wireless message 120E may include the path history data 196 for the fifth DSRC-equipped vehicle 123E. For example, the set of path history data 196 included in the fifth wireless message 120E may describe how the fifth DSRC-equipped vehicle 123E swerved from the second lane 107 to the first lane 109 to avoid the traffic obstruction 181 similar to the path of the third DSRC-equipped vehicle 123C and the fourth DSRC-equipped vehicle 123D as depicted in FIG. 1B.

In some implementations, the swerving of the fifth DSRC-equipped vehicle 123E may be described as a set of time/location pairs included in the path history data 196 of the fifth wireless message 120E. For example, the path history data 196 may describe the geographic location of the fifth DSRC-equipped vehicle 123 at a plurality of different times wherein each set of geographic coordinates has an associated time stamp. The geographic location may be sourced from a DSRC-compliant GPS unit of the fifth DSRC-equipped vehicle 123E so that the location of the fifth DSRC-equipped vehicle 123E may be sufficiently accurate to determine which lane the fifth DSRC-equipped vehicle 123E is located in at any given timestamp included in the path history data 196 of the fifth wireless message 120E.

The fourth DSRC-equipped vehicle 123D may transmit a fourth wireless message 120D to the RSU 104. The fourth wireless message 120D may include the path history data 196 for the fourth DSRC-equipped vehicle 123D. For example, the set of path history data 196 included in the fourth wireless message 120D may describe how the fourth DSRC-equipped vehicle 123D swerved from the second lane 107 to the first lane 109 to avoid the traffic obstruction 181 as depicted in FIG. 1B.

In some implementations, the swerving of the fourth DSRC-equipped vehicle 123D may be described as a set of time/location pairs included in the path history data 196 of the fourth wireless message 120D. The geographic location may be sourced from a DSRC-compliant GPS unit of the fourth DSRC-equipped vehicle 123D so that the location of the fourth DSRC-equipped vehicle 123D may be sufficiently accurate to determine which lane the fourth DSRC-equipped vehicle 123D is located in at any given timestamp included in the path history data 196 of the fourth wireless message 120D.

The third DSRC-equipped vehicle 123C may transmit a third wireless message 120C to the RSU 104. The third wireless message 120C may include the path history data 196 for the third DSRC-equipped vehicle 123C. For example, the set of path history data 196 included in the third wireless message 120C may describe how the third DSRC-equipped vehicle 123C swerved from the second lane 107 to the first lane 109 to avoid the traffic obstruction 181 as depicted in FIG. 1B.

In some implementations, the swerving of the third DSRC-equipped vehicle 123C may be described as a set of time/location pairs included in the path history data 196 of the third wireless message 120C. The geographic location may be sourced from a DSRC-compliant GPS unit of the third DSRC-equipped vehicle 123C so that the location of the third DSRC-equipped vehicle 123C may be sufficiently accurate to determine which lane the third DSRC-equipped vehicle 123C is located in at any given timestamp included in the path history data 196 of the third wireless message 120C.

The second DSRC-equipped vehicle 123B may transmit a second wireless message 120B directly to the first DSRC-equipped vehicle 120A. For example, the second wireless message 120B may include a full-duplex wireless message, a DSRC message, a DSRC probe or a BSM. The second wireless message 120B may include the path history data 196 for the second DSRC-equipped vehicle 123B. For example, the set of path history data 196 included in the second wireless message 120B may describe the geographic location of the second DSRC-equipped vehicle 123 at various times as it approaches the geographic location of the traffic obstruction 181. The path history data 196 may include time/location pairs where the location is sourced from a DSRC-compliant GPS unit of the second DSRC-equipped vehicle 123B.

In some implementations, the second wireless message 120B may include sensor data that describes the traffic obstruction 181. For example, one or more images of the traffic obstruction 181 may be included in the second wireless message 120B.

The first DSRC-equipped vehicle 123A may receive the second wireless message 120B. The RSU 104 may aggregate the path history data 196 for the other DSRC-equipped vehicles 123E, 123D, 123C. The RSU 104 may transmit a first RSU wireless message 121 to the first DSRC-equipped vehicle 123A that includes the path history data for the other DSRC-equipped vehicles 123E, 123D, 123C. The first RSU wireless message 121 may be a DSRC message, a DSRC probe, a BSM, a full-duplex wireless message or some other form of wireless message transmitted via Wi-Fi, 3G, 4G, LTE, VoLTE, or any derivative thereof. The estimation system 199 of the first DSRC-equipped vehicle 123A may then estimate a presence of the traffic obstruction 181 based on the path history data 196 of the second, third, fourth and fifth DSRC-equipped vehicles 123B, 123C, 123D, 123E.

In some implementations, RSU 104 may transmit a second RSU wireless message 124 to the vehicle 122. The second RSU wireless message 124 may include similar content as described above for the first RSU wireless message 121. The second RSU wireless message 124 may be any wireless message type except for a DSRC message, a DSRC probe or a BSM. For example, the second RSU wireless message 124 is transmitted via LTE to the vehicle 122. In this way an estimation system 199 of the vehicle 122 may estimate the presence of the traffic obstruction 181 even though the vehicle 122 itself is not DSRC-enabled.

Implementations that may include the operating environment 111 may beneficially require no servers such as the server 103, or the expense and delay associated with the same. These implementations may also require no new standardization since they may utilize any BSM data 195 from any DSRC-equipped vehicle 123.

FIG. 1B may be described in more detail below with reference to FIGS. 3A and 3B.

Referring now to FIG. 1C, depicted is a block diagram illustrating an example operating environment 112 for a plurality of DSRC-equipped vehicles 123A, 123B, 123C, 123D, 123E each including an estimation system 199 that is not pictured in FIG. 1C (e.g., a first estimation system 199A, a second estimation system 199B, a third estimation system 199C, a fourth estimation system 199D, a fifth estimation system 199E for each of the DSRC-equipped vehicles 123A, 123B, 123C, 123D, 123E, respectively), according to some implementations. Each of the DSRC-equipped vehicles 123A, 123B, 123C, 123D, 123E may include elements that are similar to those described above for the first DSRC-equipped vehicle 123A, and so, those descriptions will not be repeated here.

In some implementations, the DSRC-equipped vehicles 123A, 123B, 123C, 123D, 123E may be of the same make (e.g., Toyota) so that the functionality described herein is only available to DSRC-equipped vehicles 123A, 123B, 123C, 123D, 123E of that make.

FIG. 1C is not drawn to scale. In some implementations, each of the first lane 109 and the second lane 107 are substantially 3 meters wide.

The operating environment 112 depicted in FIG. 1C includes the following elements that are similar to those described above for the operating environment 111 of FIG. 1B: a first lane 109; a second lane 107; a first DSRC-equipped vehicle 123A; second DSRC-equipped vehicle 123B; a third DSRC-equipped vehicle 123C; a fourth DSRC-equipped vehicle 123D; a fifth DSRC-equipped vehicle; and an RSU 104. These elements were described above with reference to FIG. 1B, and so, those descriptions will not be repeated here.

The operating environment 112 also includes a network 105 and a server 103. These elements were described above with reference to FIG. 1A, and so, those descriptions will not be repeated here.

In FIG. 1C, the second DSRC-equipped vehicle 123B does not transmit the second wireless message 120B directly to the first DSRC-equipped vehicle 123A. Instead, this second wireless message 120B is transmitted to the RSU 104, similar to the third, fourth and fifth wireless messages 120C, 120D, 120E. The RSU 104 may transmit a third RSU wireless message 171 to the network 105. The third RSU wireless message 171 may include the aggregated path history data 196 of the second, third, fourth and fifth DSRC-equipped vehicles 123B, 123C, 123D, 123E. The server 103 may receive the third RSU wireless message 171 from the network 105.

The estimation system 199 of the server 103 may determine estimates of the traffic obstructions that are relevant to the first DSRC-equipped vehicle 123A based on the geographic location of the first DSRC-equipped vehicle 123A. The estimation system 199 may transmit a server wireless message 173 to the first DSRC-equipped vehicle 123A via the network 105. The server wireless message 173 may include estimate data that may be relevant to the first DSRC-equipped vehicle 123A based on the location of the first DSRC-equipped vehicle 123A.

For example, the estimation system 199 of the first DSRC-equipped vehicle 123A may provide a query to the server 103 via the network 105 that requests estimation data for the first DSRC-equipped vehicle 123A and includes location data describing a location of the first DSRC-equipped vehicle 123A (which may be sourced via a DSRC-compliant GPS unit). The estimation system 199 of the server 103 may identify estimate data that is relevant to the first DSRC-equipped vehicle 123A based on its location. This estimate data may describe the traffic obstruction 181 because the traffic obstruction is near the first DSRC-equipped vehicle and present in the same lane as the first DSRC-equipped vehicle 123A.

Optionally, the RSU 104 may provide a fourth RSU wireless message 172 to the first DSRC-equipped vehicle 123A that includes path history data 196 for the other DSRC-equipped vehicles 123B, 123C, 123D, 123E and the estimation system 199 of the first DSRC-equipped vehicle 123A may determine estimate data that describes the presence of the obstruction 181 based on this information.

The key shown in the bottom right-hand corner of FIG. 1C includes a description of example implementations of the fourth RSU wireless message 172 and the server wireless message 173. These examples are not intended to be limiting.

Referring now to FIG. 2, depicted is a block diagram illustrating an example computer system 200 including an estimation system 199 according to some implementations.

In some implementations, the computer system 200 may include a special-purpose computer system that is programmed to perform one or more steps of a method 300 described below with reference to FIGS. 3A and 3B.

In some implementations, the computer system 200 may include a DSRC-equipped vehicle 123 or any vehicle that includes the estimation system 199.

In some implementations, the computer system 200 may include an onboard vehicle computer of the DSRC-equipped vehicle 123.

In some implementations, the computer system 200 may include an engine control unit, head unit or some other processor-based computing device of the DSRC-equipped vehicle 123.

The computer system 200 may include one or more of the following elements according to some examples: the estimation system 199; a processor 225; a communication unit 245; the DSRC module 190; the sensor set 182; the DSRC-compliant GPS unit 170; an ADAS system 280; a storage 241; and a memory 227. The components of the computer system 200 are communicatively coupled by a bus 220.

In the illustrated implementation, the processor 225 is communicatively coupled to the bus 220 via a signal line 238. The communication unit 245 is communicatively coupled to the bus 220 via a signal line 246. The DSRC module 190 is communicatively coupled to the bus 220 via a signal line 247. The sensor set 182 is communicatively coupled to the bus 220 via a signal line 248. A DSRC-compliant GPS unit 170 is communicatively coupled to the bus 220 via a signal line 249. The ADAS system 280 is communicatively coupled to the bus 220 via a signal line 239. The storage 241 is communicatively coupled to the bus 220 via a signal line 242. The memory 227 is communicatively coupled to the bus 220 via a signal line 244.

The DSRC module 190, the sensor set 182 and the DSRC-compliant GPS unit 170 were described above with reference to FIG. 1A, and so, those descriptions will not be repeated here.

The processor 225 includes an arithmetic logic unit, a microprocessor, a general purpose controller, or some other processor array to perform computations and provide electronic display signals to a display device. The processor 225 processes data signals and may include various computing architectures including a complex instruction set computer (CISC) architecture, a reduced instruction set computer (RISC) architecture, or an architecture implementing a combination of instruction sets. Although FIG. 2 includes a single processor 225, multiple processors may be included. Other processors, operating systems, sensors, displays, and physical configurations may be possible.

The memory 227 stores instructions or data that may be executed by the processor 225. The instructions or data may include code for performing the techniques described herein. The memory 227 may be a dynamic random access memory (DRAM) device, a static random access memory (SRAM) device, flash memory, or some other memory device. In some implementations, the memory 227 also includes a non-volatile memory or similar permanent storage device and media including a hard disk drive, a floppy disk drive, a CD-ROM device, a DVD-ROM device, a DVD-RAM device, a DVD-RW device, a flash memory device, or some other mass storage device for storing information on a more permanent basis.

As illustrated in FIG. 2, the memory 227 stores one or more of the following elements: the DSRC data 194; the BSM data 195; the path history data 196; the estimate data 197; sensor data 296; and location data 297. The following elements of the memory 227 were described above with reference to FIGS. 1A-1D, and so, these descriptions will not be repeated here: the DSRC data 194; the BSM data 195; the path history data 196; and the estimate data 197.

The sensor data 296 may include data describing one or more physical measurements collected by one or more sensors of the sensor set 182.

The location data 297 may include location data received, generated or provided by the DSRC-compliant GPS unit 170.

The communication unit 245 transmits and receives data to and from a network 105 or to another communication channel. In some implementations, the DSRC module 190 may be an element of the communication unit 245. For example, the communication unit 245 may include a DSRC transceiver, a DSRC receiver and other hardware or software necessary to make the computer system 200 a DSRC-enabled device.

In some implementations, the communication unit 245 includes a port for direct physical connection to the network 105 or to another communication channel. For example, the communication unit 245 includes a USB, SD, CAT-5, or similar port for wired communication with the network 105. In some implementations, the communication unit 245 includes a wireless transceiver for exchanging data with the network 105 or other communication channels using one or more wireless communication methods, including: IEEE 802.11; IEEE 802.16, BLUETOOTH®; EN ISO 14906: 2004 Electronic Fee Collection—Application interface EN 12253:2004 Dedicated Short-Range Communication—Physical layer using microwave at 5.8 GHz (review); EN 12795:2002 Dedicated Short-Range Communication (DSRC)—DSRC Data link layer: Medium Access and Logical Link Control (review); EN 12834:2002 Dedicated Short-Range Communication—Application layer (review); EN 13372:2004 Dedicated Short-Range Communication (DSRC)—DSRC profiles for RTTT applications (review); the communication method described in U.S. patent application Ser. No. 14/471,387 filed on Aug. 28, 2014 and entitled "Full-Duplex Coordination System"; or another suitable wireless communication method.

In some implementations, the communication unit 245 includes a full-duplex coordination system as described in U.S. patent application Ser. No. 14/471,387 filed on Aug. 28, 2014 and entitled "Full-Duplex Coordination System."

In some implementations, the communication unit 245 includes a cellular communications transceiver for sending and receiving data over a cellular communications network including via short messaging service (SMS), multimedia messaging service (MMS), hypertext transfer protocol (HTTP), direct data connection, WAP, e-mail, or another suitable type of electronic communication. In some implementations, the communication unit 245 includes a wired port and a wireless transceiver. The communication unit 245 also provides other conventional connections to the network 105 for distribution of files or media objects using standard network protocols including TCP/IP, HTTP, HTTPS, and SMTP, millimeter wave, DSRC, etc.

The storage 241 can be a non-transitory storage medium that stores data for providing the functionality described herein. The storage 241 may be a dynamic random access memory (DRAM) device, a static random access memory (SRAM) device, flash memory, or some other memory devices. In some implementations, the storage 241 also includes a non-volatile memory or similar permanent storage device and media including a hard disk drive, a floppy disk drive, a CD-ROM device, a DVD-ROM device, a DVD-RAM device, a DVD-RW device, a flash memory device, or some other mass storage device for storing information on a more permanent basis.

The ADAS system 280 may include one or more advanced driver assistance systems. Examples of an ADAS system 280 may include one or more of the following elements of a vehicle 123: an adaptive cruise control ("ACC") system; an adaptive high beam system; an adaptive light control system; an automatic parking system; an automotive night vision system; a blind spot monitor; a collision avoidance system; a crosswind stabilization system; a driver drowsiness detection system; a driver monitoring system; an emergency driver assistance system; a forward collision warning system; an intersection assistance system; an intelligent speed adaption system; a lane departure warning system; a pedestrian protection system; a traffic sign recognition system; a turning assistant; and a wrong-way driving warning system.

In some implementations, the ADAS system 280 includes any hardware or software that controls one or more operations of a vehicle to that the vehicle is "autonomous" or "semi-autonomous."

In the illustrated implementation shown in FIG. 2, the estimation system 199 includes a communication module 202, a sensor module 204, the path history module 180 and a recommendation module 206. These components of the estimation system 199 are communicatively coupled to each other via the bus 220. In some implementations, components of the estimation system 199 can be stored in a single server or device. In some other implementations, components of the estimation system 199 can be distributed and stored across multiple servers or devices.

The communication module 202 can be software including routines for handling communications between the estimation system 199 and other components of the computer system 200. In some implementations, the communication module 202 can be a set of instructions executable by the processor 225 to provide the functionality described below for handling communications between the estimation system 199 and other components of the computer system 200. In some implementations, the communication module 202 can be stored in the memory 227 of the computer system 200 and can be accessible and executable by the processor 225. The communication module 202 may be adapted for cooperation and communication with the processor 225 and other components of the computer system 200 via signal line 222.

The communication module 202 sends and receives data, via the communication unit 245, to and from one or more elements of the operating environments 100, 111, 112. For example, the communication module 202 receives, via the communication unit 245, one or more of the following: the DSRC data 194; the BSM data 195; the path history data 196; the estimate data 197; the sensor data 296; and the location data 297.

In some implementations, the communication module 202 receives data from components of the estimation system 199 (or one or more of the example operating environments 100, 111, 112) and stores the data in one or more of the storage 241 and the memory 227. For example, the communication module 202 receives the path history data 196 from the path history module 180 or the communication unit 245 (via the network 105, a DSRC message, a BSM, a DSRC probe, a full-duplex wireless message, etc.) and stores the path history data 196 in the memory 227. In another example, the communication module 202 may receive the location data 297 from the DSRC-compliant GPS unit 170 and store the location data 297 in the memory 227.

In some implementations, the communication module 202 may handle communications between components of the estimation system 199. For example, the communications module 202 may handle communications between the sensor module 204 and the path history module 180.

The sensor module 204 can be software including routines for using one or more of the sensors included in the sensor set 182 to generate the sensor data 296. For example, the sensor module 204 may include code and routines that, when executed by the processor 225, cause the processor 225 to operate one or more of the sensors included in the sensor set 182 to record measurements of the physical environment proximate to the computer system 200 (e.g., a DSRC-equipped vehicle 123, a vehicle 122 or any vehicle that includes the estimation system 199) and identify a path history or trajectory of the computer system 200.

In some implementations, the sensor module 204 may generate sensor data 296 describing the measurements of the sensor set 182. The sensor module 204 may cause the sensor data 296 to be stored in the memory 227. In some implementations, the sensor module 204 can be stored in the memory 227 of the computer system 200 and can be accessible and executable by the processor 225. The sensor module 204 may be adapted for cooperation and communication with the processor 225 and other components of the computer system 200 via the signal line 224.

The path history module 180 was described above with reference to FIGS. 1A through 1D, and so, this description will not be repeated here. The path history module 180 may analyze the sensor data 296 to determine a path or trajectory of the computer system 200. The path history module 180 may track the location of the computer system 200 on a roadway (or in a particular lane of the roadway) over a period of time to determine a rate of travel of the computer system 200 on the roadway. For example, the path history module 180 may determine where the computer system 200 is located on the roadway (or in a particular lane of the roadway) at a plurality of different times. The path history module 180 may generate the path history data 196 based on the sensor data 296.

In some implementations, the path history data 196 generated by the path history module 180 may describe one or more of the following: the locations of the computer system 200 at different times; the heading of the computer system 200 when located at the locations; the velocity of the computer system 200 when located at the locations; the acceleration of the computer system 200 at the locations; whether the brakes where engaged at the locations; the activity or engagement of the ADAS system 280 at the locations.

In some implementations, the path history module 180 may build a wireless message that includes the path history data 196. The path history module 180 may cause the communication unit 245 or the DSRC module 190 to transmit or broadcast the wireless message.

In some implementations, the path history module 180 can be stored in the memory 227 of the computer system 200 and can be accessible and executable by the processor 225. The path history module 180 may be adapted for cooperation and communication with the processor 225 and other components of the computer system 200 via signal line 281.

The recommendation module 206 can be software including routines for generating the estimate data 197 based on the path history data 196.

In some implementations, the recommendation module 206 may generate a recommendation that describes an estimate whether an obstruction is present on the upcoming roadway, what type of obstruction is present on the roadway (e.g., based on sensor data included in the wireless message such as pictures which may be mapped to known object priors described by object prior data that may be stored in the memory 227), where the obstruction is located with lane-level description (e.g., "An obstruction is present 1000 meters ahead in your current lane of travel") and what action the driver may take responsive to the presence of the obstruction (e.g., "move two lanes over to your left," "proceed on the new navigation route depicted on your display," "slow down to 35 miles per hour and prepare to brake," etc.). The recommendation may be displayed as a graphical user interface on a monitor or provided as an audio message that is provided to the user via one or more speakers.

In some implementations, the recommendation module 206 can be stored in the memory 227 of the computer system 200 and can be accessible and executable by the processor 225. The recommendation module 206 may be adapted for cooperation and communication with the processor 225 and other components of the computer system 200 via signal line 226.

Figure 3A:
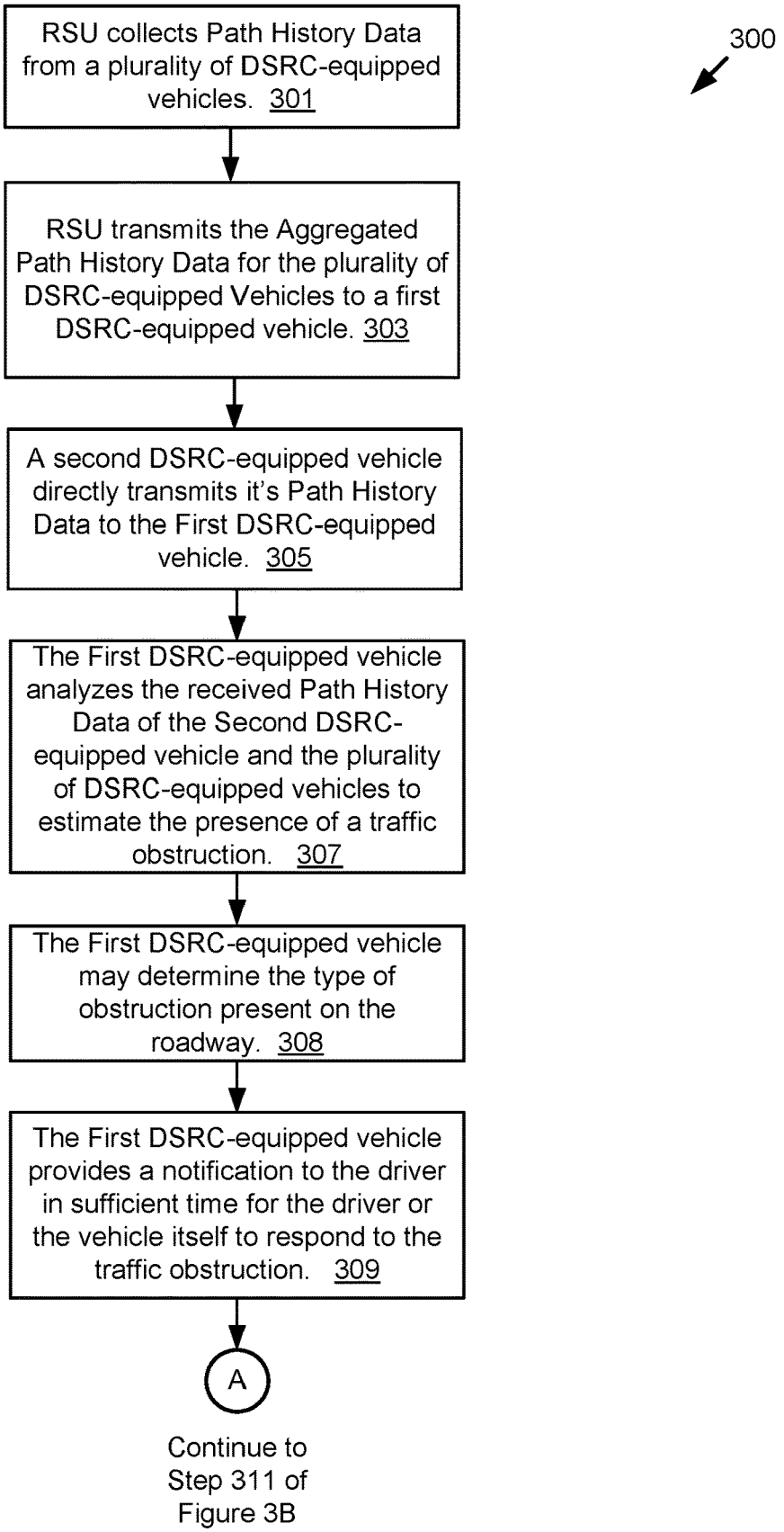
FIGS. 3A and 3B are a flowchart of an example method for estimating a presence of an obstruction in a specific lane of a roadway according to some implementations.
Figure 3B:
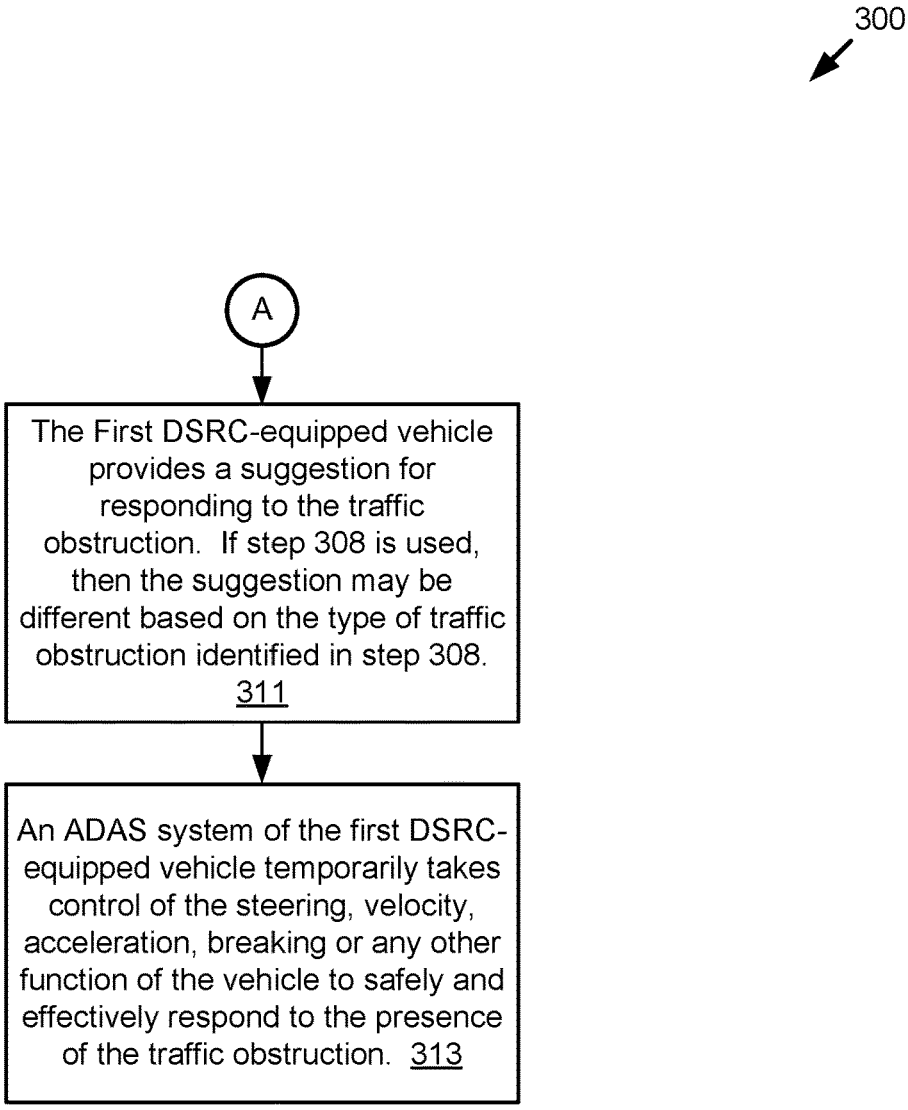

Referring now to FIGS. 3A and 3B, depicted are a flowchart of an example method 300 for estimating a presence of an obstruction in a specific lane of a roadway according to some implementations. One or more of the steps described herein for the method 300 may be executed by one or more estimation systems.

At step 301, an RSU collects path history data from a plurality of DSRC-equipped vehicles. For example, the RSU may collect path history data from DSRC-equipped vehicles (123C, 123D, 123E) as described above with reference to FIG. 1B. These DSRC-equipped vehicles may be located down the road from a first DSRC-equipped vehicle which is traveling in the same direction or heading as the plurality of DSRC-equipped vehicles. The plurality of DSRC-equipped vehicles may wirelessly transmit the wireless messages including the path history data to the RSU. The RSU may build aggregated path history data based on the path history data received from the plurality of DSRC-equipped vehicles.

At step 303, the RSU may transmit a wireless message to the first DSRC-equipped vehicle. Step 303 may occur at a time prior to when the first DSRC-equipped vehicle is present at a same or similar geographic location as any of the plurality of DSRC-equipped vehicles so that the plurality of DSRC-equipped vehicles are still down the road from the first DSRC-equipped vehicle. See, for example, FIG. 1B.

At step 305, the second DSRC-equipped vehicle may directly transmit its path history data to the first DSRC-equipped vehicle. The second DSRC-equipped vehicle may also be down the road from the first DSRC-equipped vehicle but its path history data may not have been transmitted to the RSU as described in step 301. See, for example, FIG. 1B in relation to the first DSRC-equipped vehicle 123A and the second DSRC-equipped vehicle 123B.

At step 307, the first DSRC-equipped vehicle may analyze the path history data received at steps 303 and 305 to estimate a presence of a traffic obstruction.

At step 308, the first DSRC-equipped vehicle may determine the type of traffic obstruction present on the roadway. For example, some of the path history data may include one or more images of the traffic obstruction (or some other sensor data) which may be compared to known object priors (e.g., object prior data) stored in a memory of the first DSRC-equipped vehicle to determine a type associated with the traffic obstruction (e.g., a wreck, debris on the roadway, etc.).

At step 309, the first DSRC-equipped vehicle may provide a notification or warning to the driver of the first DSRC-equipped vehicle in sufficient time for the driver or the ADAS system of the first DSRC-equipped vehicle to respond to the traffic obstruction.

Referring now to FIG. 3B. At step 311, the first DSRC-equipped vehicle may provide a suggestion for responding to the traffic obstruction. The suggestion may be different based on the type of traffic obstruction that is estimated to be present on the roadway.

At step 313, an ADAS system of the first DSRC-equipped vehicle may temporarily take control of the steering, velocity, acceleration, breaking, or any other function of the first DSRC-equipped vehicle to safety and effectively respond to the presence of the traffic obstruction.

Referring now to FIG. 4A, depicted is a block diagram illustrating an example of the BSM data 195 according to some implementations.

The regular interval for transmitting BSMs may be user configurable. In some implementations, a default setting for this interval may be transmitting the BSM every 0.10 seconds or substantially every 0.10 seconds.

A BSM may be broadcasted over the 5.9 GHz DSRC band. DSRC range may be substantially 1,000 meters. In some implementations, DSRC range may include a range of substantially 100 meters to substantially 1,000 meters.

Referring now to FIG. 4B, depicted is a block diagram illustrating an example of BSM data 195 according to some implementations.

A BSM may include two parts. These two parts may include different BSM data 195 as shown in FIG. 4B.

Part 1 of the BSM data 195 may describe one or more of the following: vehicle position; vehicle heading; vehicle speed; vehicle acceleration; vehicle steering wheel angle; and vehicle size.

Part 2 of the BSM data 195 may include a variable set of data elements drawn from a list of optional elements. Some of the BSM data 195 included in Part 2 of the BSM are selected based on event triggers, e.g., anti-locking brake system ("ABS") being activated may trigger BSM data 195 relevant to the ABS system of the vehicle.

In some implementations, some of the elements of Part 2 are transmitted less frequently in order to conserve bandwidth.

In some implementations, the BSM data 195 included in a BSM includes current snapshots of a vehicle traveling along a roadway system.

In some implementations, some or all of the information described above for the BSM data 195 may be included in the DSRC data 194.

One or more of the following devices may be a communication device: a DSRC-equipped vehicle 123; a vehicle 122; a server 103; and an RSU 104. Regarding U.S. patent application Ser. No. 14/471,387 filed on Aug. 28, 2014 and entitled "Full-Duplex Coordination System," in a half-duplex communication system, a first communication device currently transmitting data to a second communication device is not capable of simultaneously receiving data from the second communication device. If the second communication device has data to transmit to the first communication device, the second communication device needs to wait until the first communication device completes its data transmission. Only one communication device is allowed to transmit data at one time in the half-duplex communication system.

In a standard IEEE 802.11 Wireless Local Area Network (WLAN), communication devices may compete for access to a wireless channel based on the Carrier Sense Multiple Access with Collision Avoidance (CSMA/CA) Medium Access Control (MAC) protocol. The IEEE 802.11 MAC protocol requires that only one communication device may use the wireless channel to transmit data at one time. If two or more communication devices transmit data over the wireless channel at the same time, a collision occurs. As a result, only the communication device that currently gains access to the wireless channel may use the wireless channel to transmit data. Other communication devices having data to transmit need to monitor the wireless channel and may compete for access to the wireless channel when the wireless channel becomes idle again.

According to one innovative aspect of the subject matter described in this disclosure, the DSRC-equipped vehicle 123 (and other communication devices such as the RSU 104, vehicle 122 or the server 103) may include a full duplex coordination system for implementing full-duplex wireless communications. The full duplex coordination system may include a processor and a memory storing instructions that, when executed, cause the full duplex coordination system to: create, at a first communication device (such as a first DSRC-equipped vehicle 123A, etc.), first data (such as any combination of the data stored on the memory 227) to transmit to a second communication device (such as a second DSRC-equipped vehicle 123B, an RSU 104, the server 103, etc.); switch a half-duplex operation mode of the first communication device to a full-duplex operation mode to activate the full-duplex operation mode of the first communication device; transmit a first portion of the first data from the first communication device to the second communication device using a wireless channel; and transmit, in the full-duplex operation mode of the first communication device, a remaining portion of the first data to the second communication device while simultaneously receiving second data (such as any combination of the data stored on the memory 227) from the second communication device using the wireless channel.

According to another innovative aspect of the subject matter described in this disclosure, a full duplex coordination system for implementing full-duplex wireless communications includes a processor and a memory storing instructions that, when executed, cause the full duplex coordination system to: receive a first portion of first data (such as any combination of the data stored on the memory 227) from a first communication device via a wireless channel; determine that a second communication device is a single destination of the first data based on the first portion of the first data; determine that the second communication device has second data (such as any combination of the data stored on the memory 227) to transmit to the first communication device; determine that the first communication device has full-duplex communication capability; switch a half-duplex operation mode of the second communication device to a full-duplex operation mode to activate the full-duplex operation mode of the second communication device; and transmit, in the full-duplex operation mode of the second communication device, the second data to the first communication device while simultaneously receiving a remaining portion of the first data from the first communication device using the wireless channel.

In general, another innovative aspect of the subject matter described in this disclosure may be embodied in methods that include: creating, at a first communication device, first data to transmit to a second communication device; switching a half-duplex operation mode of the first communication device to a full-duplex operation mode to activate the full-duplex operation mode of the first communication device; transmitting a first portion of the first data from the first communication device to the second communication device using a wireless channel; and transmitting, in the full-duplex operation mode of the first communication device, a remaining portion of the first data to the second communication device while simultaneously receiving second data from the second communication device using the wireless channel.

Yet another innovative aspect of the subject matter described in this disclosure may be embodied in methods that include: receiving a first portion of first data from a first communication device via a wireless channel; determining that a second communication device is a single destination of the first data based on the first portion of the first data; determining that the second communication device has second data to transmit to the first communication device; determining that the first communication device has full-duplex communication capability; switching a half-duplex operation mode of the second communication device to a full-duplex operation mode to activate the full-duplex operation mode of the second communication device; and transmitting, in the full-duplex operation mode of the second communication device, the second data to the first communication device while simultaneously receiving a remaining portion of the first data from the first communication device using the wireless channel.

Another innovative aspect of the subject matter described in this disclosure may be embodied in methods that include: determining first data to transmit from a first communication device to a second communication device; and transmitting, from the first communication device that operates in a full-duplex operation mode, the first data to the second communication device while simultaneously receiving second data from the second communication device using a common wireless channel.

Another innovative aspect of the subject matter described in this disclosure may be embodied in methods that include: receiving, from a first communication device, first data at a second communication device via a wireless channel; determining second data to transmit from the second communication device to the first communication device responsive to receiving at least a portion of the first data; and transmitting, from the second communication device that operates in a full-duplex operation mode, the second data to the first communication device using the wireless channel while simultaneously receiving the first data from the first communication device.

Another innovative aspect of the subject matter described in this disclosure may be embodied in methods that include: determining, at a first communication device, first data to transmit to a second communication device; switching the first communication device from a half-duplex operation mode to a full-duplex operation mode; transmitting, in the full-duplex operation mode of the first communication device, the first data to the second communication device while simultaneously receiving second data from the second communication device using the wireless channel; and switching the full-duplex operation mode of the first communication device to the half-duplex operation mode responsive to a determination that transmission of the first data completes.

Another innovative aspect of the subject matter described in this disclosure may be embodied in methods that include: receiving, from a first communication device, first data at a second communication device via a wireless channel; determining that the second communication device has second data to transmit to the first communication device; switching the second communication device from a half-duplex operation mode to a full-duplex operation mode; transmitting, in the full-duplex operation mode of the second communication device, the second data to the first communication device while simultaneously receiving the first data from the first communication device using the wireless channel; and switching the full-duplex operation mode of the second communication device to the half-duplex operation mode responsive to a determination that transmission of the second data completes.

Other aspects include corresponding methods, systems, apparatus, and computer program products for these and other innovative aspects.

These and other implementations may each optionally include one or more of the following operations and features. For instance, the features include: the first data including a first packet and the first portion of the first data including a header portion of the first packet; the remaining portion of the first data including a payload portion and a trailer portion of the first packet; determining that the second communication device is a single destination of the first data; activating the full-duplex operation mode of the first communication device responsive to the second communication device being the single destination of the first data; the first communication device and the second communication device being communication devices in a wireless local area network; determining that the first communication device operates in a regulated spectrum where full-duplex communication capability is required; receiving device registry data associated with the first communication device; determining that the first communication device has full-duplex communication capability based on the device registry data; and determining that the first communication device has full-duplex communication capability based on a capability indication field in the first portion of the first data, the capability indication field including data describing whether the first communication device has full-duplex communication capability.

For instance, the operations include: determining that the wireless channel is idle; and accessing the wireless channel for data communication between the first communication device and the second communication device based on a channel access rule.

The disclosure is particularly advantageous in a number of respects. For example, the system described herein is capable of achieving a higher throughput and a faster communication speed using full-duplex communication technologies rather than using half-duplex communication technologies. The full-duplex communication may be implemented between vehicles (e.g., one or more full-duplex coordination systems installed in the first DSRC-equipped vehicle 123A, the second DSRC-equipped vehicle 123B, the RSU 104, the server 103 such as those depicted in FIG. 1A, 1B or 1C) or other communication devices that have full-duplex communication capability. In another example, the system coordinates communication between communication devices in a distributed way without using a central coordinator. The system determines a pair of communication devices and coordinates simultaneous transmission of data between the pair of communication devices so that the pair of communication devices may transmit data to each other simultaneously using the same wireless channel. Meanwhile, other communication devices may not transmit data over the wireless channel to avoid collision. The advantages of the system described herein are provided by way of example, and the system may have numerous other advantages.

The disclosure includes a system and method for implementing full-duplex wireless communications between communication devices. A full-duplex coordination system may include a processor and a memory storing instructions that, when executed, cause the full-duplex coordination system to: create, at a first communication device, first data to transmit to a second communication device; switch a half-duplex operation mode of the first communication device to a full-duplex operation mode to activate the full-duplex operation mode of the first communication device; transmit a first portion of the first data from the first communication device to the second communication device using a wireless channel; and transmit, in the full-duplex operation mode of the first communication device, a remaining portion of the first data to the second communication device while simultaneously receiving second data from the second communication device using the wireless channel.

In the above description, for purposes of explanation, numerous specific details are set forth in order to provide a thorough understanding of the specification. It will be apparent, however, to one skilled in the art that the disclosure can be practiced without these specific details. In some instances, structures and devices are shown in block diagram form in order to avoid obscuring the description. For example, the present implementations can be described above primarily with reference to user interfaces and particular hardware. However, the present implementations can apply to any type of computer system that can receive data and commands, and any peripheral devices providing services.

Reference in the specification to "some implementations" or "some instances" means that a particular feature, structure, or characteristic described in connection with the implementations or instances can be included in at least one implementation of the description. The appearances of the phrase "in some implementations" in various places in the specification are not necessarily all referring to the same implementations.

Some portions of the detailed descriptions that follow are presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise as apparent from the following discussion, it is appreciated that throughout the description, discussions utilizing terms including "processing" or "computing" or "calculating" or "determining" or "displaying" or the like, refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission, or display devices.

The present implementations of the specification can also relate to an apparatus for performing the operations herein. This apparatus may be specially constructed for the required purposes, or it may include a general-purpose computer selectively activated or reconfigured by a computer program stored in the computer. Such a computer program may be stored in a computer-readable storage medium, including, but is not limited to, any type of disk including floppy disks, optical disks, CD-ROMs, and magnetic disks, read-only memories (ROMs), random access memories (RAMs), EPROMs, EEPROMs, magnetic or optical cards, flash memories including USB keys with non-volatile memory, or any type of media suitable for storing electronic instructions, each coupled to a computer system bus.

The specification can take the form of some entirely hardware implementations, some entirely software implementations or some implementations containing both hardware and software elements. In some preferred implementations, the specification is implemented in software, which includes, but is not limited to, firmware, resident software, microcode, etc.

Furthermore, the description can take the form of a computer program product accessible from a computer-usable or computer-readable medium providing program code for use by or in connection with a computer or any instruction execution system. For the purposes of this description, a computer-usable or computer-readable medium can be any apparatus that can contain, store, communicate, propagate, or transport the program for use by or in connection with the instruction execution system, apparatus, or device.

A data processing system suitable for storing or executing program code will include at least one processor coupled directly or indirectly to memory elements through a system bus. The memory elements can include local memory employed during actual execution of the program code, bulk storage, and cache memories which provide temporary storage of at least some program code in order to reduce the number of times code must be retrieved from bulk storage during execution.

Input/output or I/O devices (including, but not limited, to keyboards, displays, pointing devices, etc.) can be coupled to the system either directly or through intervening I/O controllers.

Network adapters may also be coupled to the system to enable the data processing system to become coupled to other data processing systems or remote printers or storage devices through intervening private or public networks. Modems, cable modem, and Ethernet cards are just a few of the currently available types of network adapters.

Finally, the algorithms and displays presented herein are not inherently related to any particular computer or other apparatus. Various general-purpose systems may be used with programs in accordance with the teachings herein, or it may prove convenient to construct more specialized apparatus to perform the required method steps. The required structure for a variety of these systems will appear from the description below. In addition, the specification is not described with reference to any particular programming language. It will be appreciated that a variety of programming languages may be used to implement the teachings of the specification as described herein.

The foregoing description of the implementations of the specification has been presented for the purposes of illustration and description. It is not intended to be exhaustive or to limit the specification to the precise form disclosed. Many modifications and variations are possible in light of the above teaching. It is intended that the scope of the disclosure be limited not by this detailed description, but rather by the claims of this application. As will be understood by those familiar with the art, the specification may be embodied in other specific forms without departing from the spirit or essential characteristics thereof. Likewise, the particular naming and division of the modules, routines, features, attributes, methodologies, and other aspects are not mandatory or significant, and the mechanisms that implement the specification or its features may have different names, divisions, or formats. Furthermore, as will be apparent to one of ordinary skill in the relevant art, the modules, routines, features, attributes, methodologies, and other aspects of the disclosure can be implemented as software, hardware, firmware, or any combination of the three. Also, wherever a component, an example of which is a module, of the specification is implemented as software, the component can be implemented as a standalone program, as part of a larger program, as a plurality of separate programs, as a statically or dynamically linked library, as a kernel-loadable module, as a device driver, or in every and any other way known now or in the future to those of ordinary skill in the art of computer programming. Additionally, the disclosure is in no way limited to implementation in any specific programming language, or for any specific operating system or environment. Accordingly, the disclosure is intended to be illustrative, but not limiting, of the scope of the specification, which is set forth in the following claims.

What is claimed is:

1. A method for a connected vehicle, the method comprising:

collecting, by a sensor set included in a first connected vehicle, sensor data that describes a plurality of locations of the first connected vehicle while the first connected vehicle is traveling on a roadway, wherein the sensor set includes a global positioning system (GPS) unit that generates the sensor data that describes the plurality of locations of the first connected vehicle with a lane-level accuracy;

building, by the first connected vehicle, first path history data;

wirelessly transmitting, by the first connected vehicle, a vehicular communication message that includes the first path history data; and determining, by a second connected vehicle that receives the vehicular communication message, a presence of an obstruction in a specific lane of the roadway based on the first path history data.

2. The method of claim 1, wherein the vehicular communication message is a basic safety message.

3. The method of claim 1, wherein the lane-level accuracy describes the plurality of locations of the first connected vehicle with an accuracy of substantially plus or minus a half of a width of the roadway.

4. The method of claim 1, further comprising:

receiving a wireless message by the second connected vehicle, wherein the wireless message is transmitted by a computing device and includes second path history data for one or more other vehicles that describes one or more paths of the one or more other vehicles while traveling on the roadway;

wherein the second connected vehicle determines the presence of the obstruction further based on the second path history data; and wherein at least one of the one or more other vehicles is not equipped to transmit vehicular communication messages or receive vehicular communication messages.

5. The method of claim 4, wherein the computing device is a Roadside Unit that aggregates the second path history data from the one or more other vehicles.

6. The method of claim 4, wherein the computing device is a server that receives the second path history data from one or more Roadside Units that aggregate the second path history data from the one or more other vehicles.

7. The method of claim 4, wherein the wireless message is a full-duplex wireless message.

8. The method of claim 4, wherein the presence of the obstruction is only determined if the first path history data and the second path history data indicate that a number of vehicles experienced the obstruction and the number exceeds a predetermined threshold of vehicles.

9. The method of claim 1, further comprising an Advanced Driver Assistance System of the second connected vehicle operating the second connected vehicle to respond to the determination of the presence of the obstruction.

10. A system in a connected vehicle comprising:

a sensor set of a first connected vehicle that is operable to collect sensor data that was generated by a Global Positioning System (GPS) unit, wherein the sensor data describes a plurality of locations of the first connected vehicle with lane-level accuracy while the first connected vehicle is travelling on a roadway;

an onboard vehicle computer system of the first connected vehicle that is communicatively coupled to the sensor set to receive the sensor data from the sensor set, the onboard vehicle computer system including a non-transitory memory storing computer code which, when executed by the onboard vehicle computer system causes the onboard vehicle computer system to build first path history data; and a transceiver of the first connected vehicle that is communicatively coupled to the onboard vehicle computer system and operable to wirelessly transmit a vehicular communication message that includes the first path history data, wherein a second connected vehicle receives the vehicular communication message and determines a presence of an obstruction in a specific lane of the roadway based on the first path history data.

11. The system of claim 10, wherein the vehicular communication message is a basic safety message.

12. The system of claim 10, wherein the lane-level accuracy describes the plurality of locations of the first connected vehicle with an accuracy of substantially plus or minus a half of a width of the roadway.

13. The system of claim 10, wherein the system further comprises an Advanced Driver Assistance System communicatively coupled to the onboard vehicle computer system and wherein the non-transitory memory further stores computer code which, when executed by the onboard vehicle computer system causes the Advanced Driver Assistance System to operate the second connected vehicle to respond to the presence of the obstruction.

14. The system of claim 10, wherein the computer code further causes the onboard vehicle computer system to:

receive a wireless message by the second connected vehicle, wherein the wireless message is transmitted by a computing device and includes second path history data for one or more other vehicles that describes one or more paths of the one or more other vehicles while traveling on the roadway;

the second connected vehicle determines the presence of the obstruction further based on the second path history data; and at least one of the one or more other vehicles is not equipped to transmit vehicular communication messages or receive vehicular communication messages.

15. The system of claim 14, wherein the computing device is a Roadside Unit that aggregates the second path history data from the one or more other vehicles.

16. The system of claim 14, wherein the computing device is a server that receives the second path history data from one or more Roadside Units that aggregate the second path history data from the one or more other vehicles.

17. The system of claim 14, wherein the wireless message is a full-duplex wireless message.

18. A computer program product comprising a non-transitory memory of an onboard vehicle computer system of a first connected vehicle storing computer-executable code that, when executed by a processor, causes the processor to:

collect, by a sensor set included in the first connected vehicle, sensor data that describes a plurality of locations of the first connected vehicle while the first connected vehicle is traveling on a roadway, wherein the sensor set includes a global positioning system (GPS) unit that generates the sensor data that describes the plurality of locations of the first connected vehicle with a lane-level accuracy;

build path history data; and wirelessly transmit a vehicular communication message that includes the path history data, wherein a second connected vehicle receives the vehicular communication message and determines a presence of an obstruction in a specific lane of the roadway based on the path history data.

19. The computer program product of claim 18, wherein the vehicular communication message is a basic safety message.

20. The computer program product of claim 18, wherein the lane-level accuracy describes the plurality of locations of the first connected vehicle with an accuracy of substantially plus or minus a half of a width of the roadway.

* * * * *